US007931472B2

(12) United States Patent
David et al.

(10) Patent No.: US 7,931,472 B2
(45) Date of Patent: Apr. 26, 2011

(54) APPARATUS FOR TRANSFERRING ELECTRIC POWER FROM A MOBILE UNIT PLACED IN VARIOUS ORIENTATION ON A STATIONARY UNIT

(76) Inventors: Arnon Haim David, Ramat Hasharon (IL); Einam Yitzhak Amotz, Jerusalem (IL)

( * ) Notice: Subject to any disclaimer, the term of this patent is extended or adjusted under 35 U.S.C. 154(b) by 0 days.

(21) Appl. No.: 12/843,028

(22) Filed: Jul. 25, 2010

(65) Prior Publication Data

US 2010/0285674 A1 Nov. 11, 2010

Related U.S. Application Data

(63) Continuation-in-part of application No. 12/343,464, filed on Dec. 23, 2008, now Pat. No. 7,771,202.

(60) Provisional application No. 61/019,301, filed on Jan. 7, 2008.

(51) Int. Cl.
*H01R 11/30* (2006.01)

(52) U.S. Cl. ..... 439/39

(58) Field of Classification Search ..... 439/38, 439/39, 40, 152, 188; 200/51.09
See application file for complete search history.

(56) References Cited

U.S. PATENT DOCUMENTS 3,521,216 A * 7/1970 Tolegian ..... 439/39
4,156,265 A 5/1979 Rose
4,442,327 A * 4/1984 West et al. ..... 200/51 R
4,451,113 A 5/1984 Zuniga
4,647,120 A 3/1987 Kline
4,874,316 A 10/1989 Kamon et al.
5,401,175 A 3/1995 Guimond et al.
5,507,303 A * 4/1996 Kuzma ..... 128/899
5,816,825 A 10/1998 Sekimori et al.
5,829,987 A * 11/1998 Fritsch et al. ..... 439/38
5,921,783 A 7/1999 Fritsch et al.
5,954,520 A 9/1999 Schmidt
6,007,363 A 12/1999 Renk
6,213,783 B1 4/2001 Kankkunen
6,217,339 B1 4/2001 Tsubata
6,527,570 B1 3/2003 Hartman et al.
6,719,576 B2 4/2004 Hartman et al.
6,962,498 B2 11/2005 Kohen
6,966,781 B1 11/2005 Bullinger et al.
7,264,479 B1 9/2007 Lee
7,311,526 B2 * 12/2007 Rohrbach et al. ..... 439/39
7,344,380 B2 3/2008 Neidlein et al.
7,351,066 B2 * 4/2008 DiFonzo et al. ..... 439/39
7,771,202 B2 * 8/2010 Amotz et al. ..... 439/39

* cited by examiner

*Primary Examiner* — Chandrika Prasad

(57) ABSTRACT

An apparatus and method for transferring power from a stationary unit to a mobile unit are introduced in order to improve on the existing methods of supplying power to appliances and mobile devices.

The stationary unit is comprised of multiple magnetic and electromagnetic switches, which are activated only when in close proximity to a mobile unit comprising of a set of magnets of opposite polarity to the magnetic and electromagnetic switches in the stationary unit thus ensuring a safe and easy to use system for supplying power from the stationary unit to the mobile unit.

The stationary unit may be large enough to allow the connection of multiple mobile units on a single stationary unit. Each mobile unit can then adjust the voltage supplied by the stationary unit to fit the requirements of its own appliance or mobile device thus allowing different types of devices to connect to the same source (the stationary unit).

20 Claims, 17 Drawing Sheets

APPARATUS FOR TRANSFERRING ELECTRIC POWER FROM A MOBILE UNIT PLACED IN VARIOUS ORIENTATION ON A STATIONARY UNIT

REFERENCE TO CROSS-RELATED APPLICATION

This application is a Continuation-in-Part of U.S. patent application Ser. No. 12/343,464 filed on Dec. 23, 2008.

This application claims priority benefits from U.S. patent application Ser. No. 12/343,464 filed on Dec. 23, 2008, which claims priority benefits from U.S. Provisional Patent Application No. 61/019,301, filed on Jan. 7, 2008, herein incorporated by reference in its entirety.

FIELD OF THE INVENTION

The present invention relates to an apparatus for transferring electrical power from a source plane to a receiving device placed in various orientations on this plane.

BACKGROUND OF THE INVENTION

Many of today's electronic devices are portable and some of them are even equipped with rechargeable batteries.

If a battery less electronic device is used, it must be connected to a power supply, i.e. 110V/220V AC power outlet.

When an electronic device equipped with rechargeable batteries is being used, the operating time of the device is limited to the available charge provided by at least one rechargeable battery. After the depletion of the batteries, the device must be connected to a power supply, i.e. 110V/220V AC power outlet in order to continue to operate and to recharge the batteries in the device.

There are a number of problems associated with conventional means of powering or charging these devices:

The devices have to be plugged into mains 110V/220V AC power outlet and hence if several are used together, they take up space in plug strips and create a messy and confusing tangle of wires.

The locations of the power outlets are fixed and the number of outlets is usually limited.

U.S. Pat. No. 3,521,216, (1970), which is incorporated by reference for all purposes as if fully set forth herein, taught the use of plug and socket assembly incorporating magnetic means for attracting and holding a plug in a socket.

There is thus a widely recognized need for, and it would be highly advantageous to have a power outlet plug and socket that do not require any alignment at all.

The prior art does not teach or suggest such a tool.

SUMMARY OF THE INVENTION

An apparatus for transferring electrical power from a source plane, to one receiving device or to a plurality of receiving devices placed in various orientations on this source plane according to the present invention can overcome the described limitations.

The apparatus includes a planar stationary unit set and at least one mobile unit set.

According to one embodiment the planar stationary unit set includes conductive plates embedded in the form of a grid in a non-conductive matrix.

An example for the matrix material could be plastic but the matrix could be made of any material that is non-conductive.

An example for the conductive plates embedded in the matrix material could be copper, but the conductive plates embedded in the matrix could be made of any material that is conductive.

Each of the plates is connected to a power grid through a switch that is normally open. i.e., there is no voltage on the plates.

Half of the plates are connected to the phase port of the electrical power grid and the other half are connected to the zero port of the electrical power grid.

The port names used hereinafter are symbolic only and are not intended to limit the application of this invention to a specific type of electrical current. The present invention may also be used with a positive port and a negative port as used in direct current (DC) power supplies.

In the case of a two dimensional stationary unit set, the plates are arranged in grid formation so that the four nearest neighboring plates of each plate are connected to the opposite port as the port that the plate itself is connected to.

All the switches of the phase port are connected to a signal-receiving device and they can be turned on if in their proximity there is a device that transmits a specific signal to the receiving device.

This transmitting device can transmit the signal (or code) through any form of transmission such as magnetic transmission, electromagnetic transmission, electrostatic transmission (capacitance), radio frequency (RF) transmission etc.

All of the switches of the zero port are connected to a signal-receiving device and they can be turned on if in their proximity there is a device that transmits a specific signal (or code) to the receiving device.

This transmitting device can transmit the signal (or code) through any form of transmission such as magnetic transmission, electromagnetic transmission, electrostatic transmission (capacitance), radio frequency (RF) transmission etc.

The phase port switch cannot be turned on by the same transmission that turns on the zero port switches and the zero port switches cannot be turned on by the same transmission that turns on the phase port switches.

According to the above embodiment, a mobile unit set that is comprised of two large conductive plates is embedded in a planar and non-conductive frame.

The plates in the mobile unit set are significantly bigger than the distances between the plates in the planar stationary unit set so that if placed on the planar stationary unit set, each of the two plates in the mobile unit set covers several plates embedded in the planar stationary unit set.

The distance between the plates in the mobile unit set is greater than the largest dimension of the plates in the planar stationary unit set so that no plate in the planar stationary unit set can be in contact with both plates in the mobile unit set.

The width of the non-conductive frame surrounding the conductive plates is grater than the largest dimension of the plates in the planar stationary unit set so that no plate in the planar stationary unit set can touch a plane and extend beyond the frame at the same time. This is required for safety reasons: it is not permissible that a live plate would be exposed; hence, the mobile unit set must cover it.

Behind each plate in the mobile unit set there is a transmitting device as mentioned before.

Each transmitting device in the mobile unit set is transmitting a different signal (or code).

One transmitting device is transmitting the signal (or code) that causes the phase port switches to turn on.

The opposite transmitting device is transmitting the signal (or code) that causes the zero port switches to turn on.

The plate that has the transmitting device that is transmitting the signal (or code) that causes the phase port switches to turn on is called the "phase plate".

The plate that has the transmitting device that is transmitting the signal (or code) that causes the zero port switches to turn on is called the "zero plate".

Following is a summary of the stages of the method according to the present invention:

When the mobile unit set is placed on the planar stationary unit, both its zero plate and the phase plate are in contact with plates that are connected to the phase port and with plates that are connected to the zero port in the stationary unit.

Of the plates that are in contact with the phase plate, only the switches that are connected to the phase port are switched on and thus an electrical connection is established between the phase plate and the phase port through the live plates.

Of the plates that are in contact with the zero plate, only the switches that are connected to the zero port are switched on and thus an electrical connection is established between the zero plate and the zero port through the live plates.

When any other device or being touches the planar stationary unit, and is in contact with the plates, it is not in electrical contact with the phase port or the zero port because the switches between the plates and the phase and zero ports are not on, thus, the exposed plates in the stationary unit are not "live" and are safe to touch.

According to the present invention there is provided an apparatus for transferring electrical power including: (a) at least one planar stationary unit set including: (i) a planar stationary unit phase assembly, having a predetermined maximum cross section width dimension d1; (ii) a planar stationary unit zero assembly, having a predetermined maximum cross section width dimension d3; and (iii) a planar stationary unit set body, wherein the planar stationary unit phase assembly and the planar stationary unit zero assembly being encased inside the planar stationary unit set body aside one another; and (b) at least one mobile unit set including: (i) a mobile unit phase assembly; and (ii) a mobile unit zero assembly; and (iii) a mobile unit set body, wherein the mobile unit phase assembly and the mobile unit zero assembly being encased inside the mobile unit set body, aside one another, and wherein the at least one mobile unit set has a mobile unit set body edge.

According to further features in an embodiment of the present invention, each one of the mobile unit phase assembly including: a mobile unit zero assembly housing; a mobile unit assembly phase assembly contact element disposed on the mobile unit zero assembly housing; and a mobile unit phase assembly magnet mounted inside the mobile unit zero assembly housing, wherein the mobile unit phase assembly magnet has a mobile unit phase assembly magnet first magnetic pole and a mobile unit phase assembly magnet second magnetic pole, wherein the mobile unit phase assembly magnet second magnetic pole is closer to the mobile unit assembly phase assembly contact element than the mobile unit phase assembly magnet first magnetic pole, wherein each one of the mobile unit zero assembly including: a mobile unit zero assembly contact element disposed on the mobile unit zero assembly housing; and a mobile unit zero assembly magnet, wherein the mobile unit zero assembly magnet, has a mobile unit zero assembly magnet first magnetic pole, and a mobile unit zero assembly magnet second magnetic pole, wherein the mobile unit phase assembly magnet first magnetic pole is closer to the mobile unit zero assembly contact element then the mobile unit zero assembly magnet second magnetic pole.

According to further features in an embodiment of the present invention, the planar stationary unit phase assembly is a magnetic switch phase assembly, wherein the magnetic switch phase assembly including: a magnetic switch phase assembly housing; a magnetic switch phase assembly housing end disk disposed on the magnetic switch phase assembly housing; a magnetic switch phase assembly contact element disposed on the magnetic switch phase assembly housing; a magnetic switch phase assembly shaft mounted inside the magnetic switch phase assembly housing; a magnetic switch phase assembly voltage element mounted on the magnetic switch phase assembly shaft, wherein there is a first gap between the magnetic switch phase assembly contact element and the magnetic switch phase assembly voltage element; a magnetic switch phase assembly magnet mounted on the magnetic switch phase assembly shaft; a magnetic switch phase assembly voltage element spring mounted inside the magnetic switch phase assembly housing, and between the magnetic switch phase assembly voltage element and the magnetic switch phase assembly housing end disk; and a magnetic switch phase assembly magnet spring mounted inside the magnetic switch phase assembly housing, and between the magnetic switch phase assembly magnet and the magnetic switch phase assembly housing end disk.

According to further features in an embodiment of the present invention, the at least one planar stationary unit set further including: (v) a planar stationary unit ground element encased inside the planar stationary unit set body, and wherein the at least one mobile unit set further including: (v) a mobile unit ground element encased inside the planar stationary unit set body.

According to another features in an embodiment of the present invention, the planar stationary unit phase assembly is an electromagnetic switch assembly, wherein the electromagnetic switch assembly including: an electromagnetic switch assembly housing; an electromagnetic switch assembly housing end disk disposed on the electromagnetic switch assembly housing; an electromagnetic switch assembly contact element disposed on the electromagnetic switch assembly housing; an electromagnetic switch assembly shaft mounted inside the electromagnetic switch assembly housing; an electromagnetic switch assembly voltage element mounted on the electromagnetic switch assembly shaft, wherein there is a second gap between the electromagnetic switch assembly contact element and the electromagnetic switch assembly voltage element; an electromagnetic switch assembly electromagnet core mounted on the electromagnetic switch assembly shaft; an electromagnetic switch assembly electromagnet coil mounted on the electromagnetic switch assembly shaft; an electromagnetic switch assembly voltage element spring mounted inside the electromagnetic switch assembly housing and between the electromagnetic switch assembly voltage element and the electromagnetic switch assembly housing end disk; and an electromagnetic switch assembly electromagnet spring mounted inside the electromagnetic switch assembly housing, and between the electromagnetic switch assembly electromagnet core and the electromagnetic switch assembly housing end disk.

According to further features in an embodiment of the present invention, the at least one planar stationary unit set further including: (v) a planar stationary unit ground element encased inside the planar stationary unit set body, and wherein the at least one mobile unit set further including: (v) a mobile unit ground element encased inside the planar stationary unit set body.

According to another features in an embodiment of the present invention, the planar stationary unit phase assembly is a cantilever version of a magnetic switch assembly, wherein the cantilever version of a magnetic switch assembly including: a cantilever version of a magnetic switch assembly housing; a cantilever version of a magnetic switch assembly contact element disposed on the cantilever version of a magnetic switch assembly housing; a cantilever version of a magnetic switch assembly voltage element wire and assembly voltage element spring disposed on the cantilever version of a magnetic switch assembly housing inside the cantilever version of a magnetic switch assembly housing; and a cantilever version of a magnetic switch assembly magnet disposed on the cantilever version of a magnetic switch assembly voltage element wire and assembly voltage element spring, wherein there is a third gap between the cantilever version of a magnetic switch assembly contact element and the cantilever version of a magnetic switch assembly magnet.

According to further features in an embodiment of the present invention, the at least one planar stationary unit set further including: (v) a planar stationary unit ground element encased inside the planar stationary unit set body, and wherein the at least one mobile unit set further including: (v) a mobile unit ground element encased inside the planar stationary unit set body.

According to another features in an embodiment of the present invention, the planar stationary unit phase assembly is a cantilever version of an electro-magnetic switch assembly, wherein the cantilever version of an electro-magnetic switch assembly including: a cantilever version of electro-magnetic switch assembly housing; a cantilever version of electro-magnetic switch assembly contact element disposed on the cantilever version of electro-magnetic switch assembly housing; a cantilever version of electro-magnetic switch assembly voltage element wire and assembly voltage element spring disposed on the cantilever version of electro-magnetic switch assembly housing inside the cantilever version of electro-magnetic switch assembly housing; a cantilever version of electro-magnetic switch assembly core disposed on the cantilever version of electro-magnetic switch assembly voltage element wire and assembly voltage element spring; and a cantilever version of electro-magnetic switch assembly electromagnet coil mounted around the cantilever version of electro-magnetic switch assembly core, wherein there is a fourth gap between the cantilever version of electro-magnetic switch assembly contact element and the cantilever version of electro-magnetic switch assembly core.

According to further features in an embodiment of the present invention, the at least one planar stationary unit set further including: (v) a planar stationary unit ground element encased inside the planar stationary unit set body, and wherein the at least one mobile unit set further including: (v) a mobile unit ground element encased inside the planar stationary unit set body.

According to another features in an embodiment of the present invention, there is a minimum predetermined distance d4 between the mobile unit phase assembly and the mobile unit zero assembly, wherein there is a minimum predetermined distance d2 from the mobile unit phase assembly, and from the mobile unit zero assembly to the mobile unit set body edge, wherein the distance d4 is larger than the maximum cross section width dimension d1 and is larger than the maximum cross section width dimension d3, and wherein the distance d2 is larger than the maximum cross section width dimension d1 and is larger than the maximum cross section width dimension d3.

According to further features in an embodiment of the present invention, the planar stationary unit phase assembly is a magnetic switch phase assembly, wherein the magnetic switch phase assembly including: a magnetic switch phase assembly housing; a magnetic switch phase assembly housing end disk disposed on the magnetic switch phase assembly housing; a magnetic switch phase assembly contact element disposed on the magnetic switch phase assembly housing; a magnetic switch phase assembly shaft mounted inside the magnetic switch phase assembly housing; a magnetic switch phase assembly voltage element mounted on the magnetic switch phase assembly shaft, wherein there is a first gap between the magnetic switch phase assembly contact element and the magnetic switch phase assembly voltage element; a magnetic switch phase assembly magnet mounted on the magnetic switch phase assembly shaft; a magnetic switch phase assembly voltage element spring mounted inside the magnetic switch phase assembly housing, and between the magnetic switch phase assembly voltage element and the magnetic switch phase assembly housing end disk; and a magnetic switch phase assembly magnet spring mounted inside the magnetic switch phase assembly housing, and between the magnetic switch phase assembly magnet and the magnetic switch phase assembly housing end disk.

According to further features in an embodiment of the present invention, the apparatus for transferring electrical power including: (c) a planar stationary unit grid body, wherein the planar stationary unit grid body, connects together a plurality of the at least one planar stationary unit set.

According to still another features in an embodiment of the present invention, the planar stationary unit phase assembly is an electromagnetic switch assembly, wherein the electromagnetic switch assembly including: an electromagnetic switch assembly housing; an electromagnetic switch assembly housing end disk disposed on the electromagnetic switch assembly housing; an electromagnetic switch assembly contact element disposed on the electromagnetic switch assembly housing; an electromagnetic switch assembly shaft mounted inside the electromagnetic switch assembly housing; an electromagnetic switch assembly voltage element mounted on the electromagnetic switch assembly shaft, wherein there is a second gap between the electromagnetic switch assembly contact element and the electromagnetic switch assembly voltage element; an electromagnetic switch assembly electromagnet core mounted on the electromagnetic switch assembly shaft; an electromagnetic switch assembly electromagnet coil mounted on the electromagnetic switch assembly shaft; an electromagnetic switch assembly voltage element spring mounted inside the electromagnetic switch assembly housing and between the electromagnetic switch assembly voltage element and the electromagnetic switch assembly housing end disk; and an electromagnetic switch assembly electromagnet spring mounted inside the electromagnetic switch assembly housing, and between the electromagnetic switch assembly electromagnet core and the electromagnetic switch assembly housing end disk.

According to further features in an embodiment of the present invention, the apparatus for transferring electrical power including: (c) a planar stationary unit grid body, wherein the planar stationary unit grid body, connects together a plurality of the at least one planar stationary unit set.

According to another features in an embodiment of the present invention, the planar stationary unit phase assembly is a cantilever version of a magnetic switch assembly, wherein the cantilever version of a magnetic switch assembly including: a cantilever version of a magnetic switch assembly housing; a cantilever version of a magnetic switch assembly contact element disposed on the cantilever version of a magnetic switch assembly housing; a cantilever version of a magnetic switch assembly voltage element wire and assembly voltage element spring disposed on the cantilever version of a magnetic switch assembly housing inside the cantilever version of a magnetic switch assembly housing; and a cantilever version of a magnetic switch assembly magnet disposed on the cantilever version of a magnetic switch assembly voltage element wire and assembly voltage element spring, wherein there is a third gap between the cantilever version of a magnetic switch assembly contact element and the cantilever version of a magnetic switch assembly magnet.

According to further features in an embodiment of the present invention, the apparatus for transferring electrical power including: (c) a planar stationary unit grid body, wherein the planar stationary unit grid body, connects together a plurality of the at least one planar stationary unit set.

According to another features in an embodiment of the present invention, the planar stationary unit phase assembly is a cantilever version of an electro-magnetic switch assembly, wherein the cantilever version of an electro-magnetic switch assembly including: a cantilever version of electro-magnetic switch assembly housing a cantilever version of electro-magnetic switch assembly contact element disposed on the cantilever version of electro-magnetic switch assembly housing; a cantilever version of electro-magnetic switch assembly voltage element wire and assembly voltage element spring disposed on the cantilever version of electro-magnetic switch assembly housing inside the cantilever version of electro-magnetic switch assembly housing; a cantilever version of electro-magnetic switch assembly core disposed on the cantilever version of electro-magnetic switch assembly voltage element wire and assembly voltage element spring; and a cantilever version of electro-magnetic switch assembly electromagnet coil mounted around the cantilever version of electro-magnetic switch assembly core, wherein there is a fourth gap between the cantilever version of electro-magnetic switch assembly contact element and the cantilever version of electro-magnetic switch assembly core.

According to further features in an embodiment of the present invention, the apparatus for transferring electrical power including: (c) a planar stationary unit grid body, wherein the planar stationary unit grid body, connects together a plurality of the at least one planar stationary unit set.

BRIEF DESCRIPTION OF THE DRAWINGS

The invention is herein described, by way of example only, with reference to the accompanying drawings, wherein.

DETAILED DESCRIPTION OF EMBODIMENTS

Figure 1A:
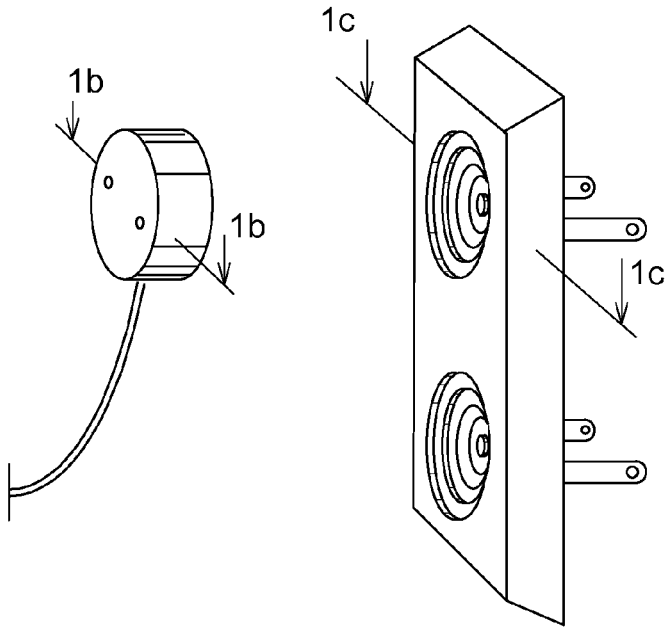
Fig.1a PRIOR ART
FIG. 1*a* of the prior art illustrates an exploded perspective view of a plug upon which the section plane 1*b*-1*b* is marked, and socket assembly upon which the section plane 1*c*-1*c* is marked, showing the plug disconnected from the socket according to U.S. Pat. No. 3,521,216.
Figure 1B:
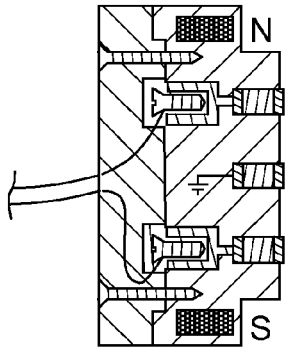
Fig.1b PRIOR ART
FIG. 1*b* is a cross section of the plug taken in the direction of the arrows 1*b*-1*b* of FIG. 1*a*.
Figure 1C:
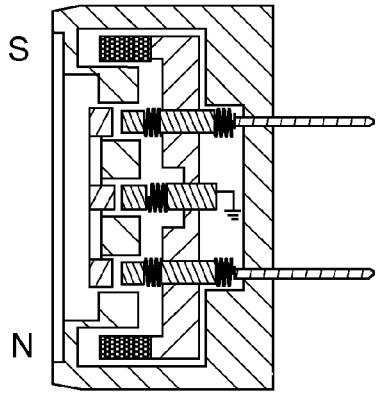
Fig.1c PRIOR ART
FIG. 1*c* is a cross section of the socket taken in the direction of the arrows 1*c*-1*c* of FIG. 1*a*.

The present invention is an apparatus for transferring electrical power from a source plane to a receiving device placed in various orientations on this plane.

The principles and operation of the apparatus for transferring electrical power from a source plane to a receiving device placed in various orientations on this plane according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined or explained, all technical and scientific terms used herein have the same meaning as commonly understood by one of ordinary skill in the art to which this invention belongs. The materials, dimensions, methods, and examples provided herein are illustrative only and are not intended to be limiting.

The following is a list of legend of the numbering of the application illustrations:

10 planar stationary unit phase assembly
10*m* planar surface
10*n* pipe
11 planar stationary unit zero assembly
12 planar stationary unit ground element
12*j* planar stationary unit ground element wire
13*a* planar stationary unit phase power supply
13*b* planar stationary unit zero power supply
13*c* planar stationary unit ground
20 mobile unit phase assembly
20*a* mobile unit assembly phase assembly contact element
20*e* mobile unit phase assembly magnet
20*h* mobile unit phase assembly housing
20*i* mobile unit phase assembly housing end disk
20*j* mobile unit phase assembly wire
20*l* mobile unit phase assembly symmetry axis
20*x* mobile unit phase assembly magnet first magnetic pole
20*y* mobile unit phase assembly magnet second magnetic pole
21 mobile unit zero assembly
21*a* mobile unit zero assembly contact element
21*e* mobile unit zero assembly magnet
21*h* mobile unit zero assembly housing
21*i* mobile unit zero assembly housing end disk
21*j* mobile unit zero assembly wire
21*l* mobile unit zero assembly symmetry axis
21*x* mobile unit zero assembly magnet first magnetic pole
21*y* mobile unit zero assembly magnet second magnetic pole
22 mobile unit ground element
22*j* mobile unit ground element wire
32 electromagnetic switch assembly
32*a* electromagnetic switch assembly contact element
32*b* electromagnetic switch assembly voltage element
32*c* electromagnetic switch assembly shaft
32*f* electromagnetic switch assembly electromagnet spring
32*g* electromagnetic switch assembly voltage element spring
32*h* electromagnetic switch assembly housing
32*i* electromagnetic switch assembly housing end disk
32*j* electromagnetic switch assembly voltage element wire
32*l* electromagnetic switch assembly symmetry axis
32*p* electromagnetic switch assembly electromagnet core
32*q* electromagnetic switch assembly electromagnet coil
32*r* electromagnetic switch assembly electromagnet coil first pin
32*s* electromagnetic switch assembly electromagnet coil second pin
32*t* electromagnetic switch assembly electromagnet
32*z* second gap
34 cantilever version of a magnetic switch assembly
34*a* cantilever version of a magnetic switch assembly contact element
34*e* cantilever version of a magnetic switch assembly magnet
34*h* cantilever version of a magnetic switch assembly housing
34*j* cantilever version of a magnetic switch assembly wire
34*jg* cantilever version of a magnetic switch assembly voltage element wire and assembly voltage element spring
34*x* cantilever version of a magnetic switch assembly magnet first magnetic pole
34*y* cantilever version of a magnetic switch assembly magnet second magnetic pole

Figure 2A:
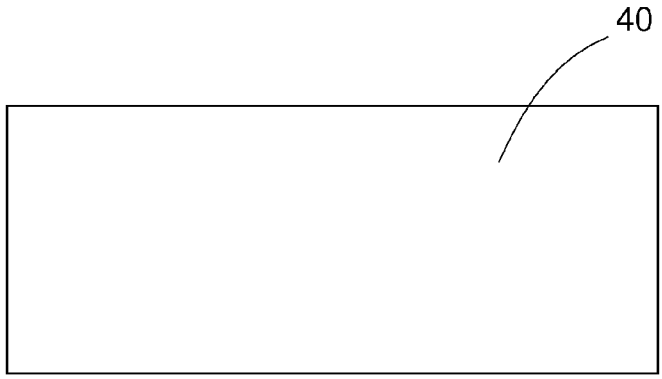
FIG. 2*a* is a side view schematic illustration of an exemplary, illustrative embodiment of a magnetic switch phase assembly, according to the present invention.

34*z* third gap
35 cantilever version of an electro-magnetic switch assembly
35*a* cantilever version of electro-magnetic switch assembly contact element
35*h* cantilever version of electro-magnetic switch assembly housing
35*jg* cantilever version of electro-magnetic switch assembly voltage element wire and assembly voltage element spring
35*p* cantilever version of electro-magnetic switch assembly core
35*q* cantilever version of electro-magnetic switch assembly electromagnet coil
35*r* cantilever version of electro-magnetic switch assembly electromagnet coil first pin
35*s* cantilever version of electro-magnetic switch assembly electromagnet coil second pin
35*z* fourth gap
40 magnetic switch phase assembly
40*a* magnetic switch phase assembly contact element
40*b* magnetic switch phase assembly voltage element
40*ba* magnetic switch phase assembly voltage element base
40*bb* magnetic switch phase assembly voltage element wall
40*c* magnetic switch phase assembly shaft
40*e* magnetic switch phase assembly magnet
40*f* magnetic switch phase assembly magnet spring
40*g* magnetic switch phase assembly voltage element spring
40*h* magnetic switch phase assembly housing
40*i* magnetic switch phase assembly housing end disk
40*j* magnetic switch phase wire
40*l* magnetic switch phase assembly symmetry axis
40*m* planar surface
40*n* pipe
40*z* first gap
40*x* magnetic switch phase assembly magnet first magnetic pole
40*y* magnetic switch phase assembly magnet second magnetic pole
41 magnetic switch zero assembly
41*a* magnetic switch zero assembly contact element
41*b* magnetic switch zero assembly voltage element
41*c* magnetic switch zero assembly shaft
41*e* magnetic switch zero assembly magnet
41*f* magnetic switch zero assembly magnet spring
41*g* magnetic switch zero assembly voltage element spring
41*h* magnetic switch zero assembly housing
41*i* magnetic switch zero assembly housing end disk
41*j* magnetic switch zero wire
41*l* magnetic switch zero assembly symmetry axis
41*x* magnetic switch zero assembly magnet first magnetic pole
41*y* magnetic switch zero assembly magnet second magnetic pole
60 non-conductive matrix
71 mains outlet plug
72 AC to DC converter
73 planar stationary unit voltage regulator
74 mobile unit voltage regulator
76 portable electronic device's power plug
100 apparatus for transferring electrical power
101 planar stationary unit set
101*a* planar stationary unit set body
102 mobile unit set
102*a* mobile unit set body
102*b* mobile unit set body edge
201 planar stationary unit grid
201*a* planar stationary unit grid body Referring now to the drawings, FIG. 2*a* is a side view schematic illustration of an exemplary, illustrative embodiment of a magnetic switch phase assembly 40, according to the present invention.

Figure 2B:
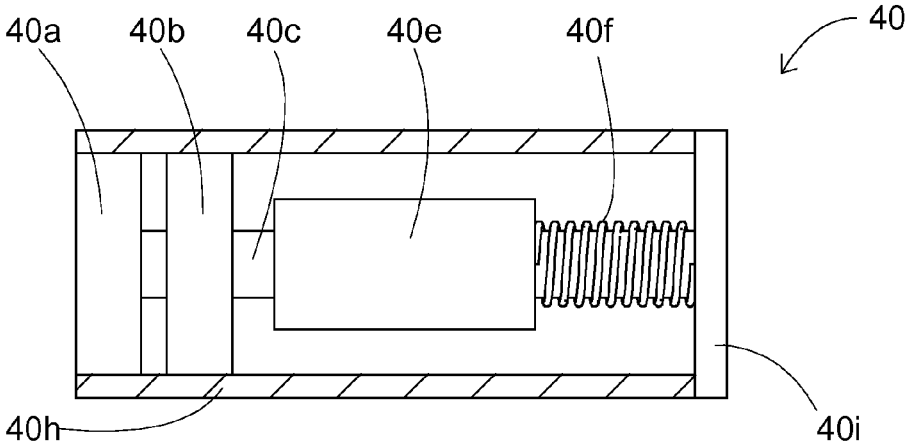
FIG. 2*b* is a partial cut-away side view schematic illustration of an exemplary, illustrative embodiment of a magnetic switch phase assembly, according to the present invention.

FIG. 2*b* is a partial cut-away side view schematic illustration of an exemplary, illustrative embodiment of a magnetic switch phase assembly 40, according to the present invention.

The figure depicts the elements comprising the magnetic switch phase assembly 40, and the way they are arranged with regards to each other, while omitting the magnetic switch phase assembly voltage element spring 40*g*, (not shown in the present illustration), and the magnetic switch phase wire 40*j*, (not shown in the present illustration).

The magnetic switch phase assembly 40 has a magnetic switch phase assembly housing 40*h*, which is electrically non-conductive, a magnetic switch phase assembly contact element 40*a*, designed to conduct electricity when in contact with a mobile unit phase assembly 20, (not shown in the present illustration), and is located at one outer edge of the magnetic switch phase assembly 40, a magnetic switch phase assembly shaft 40*c*, which is electrically non-conductive, is located in the middle of the magnetic switch phase assembly housing 40*h*, on which other elements may travel over, such as a magnetic switch phase assembly voltage element 40*b*, receiving an electrical voltage by means of a magnetic switch phase wire 40*j*, (not shown in the present illustration), and a magnetic switch phase assembly magnet 40*e*, attached to a magnetic switch phase assembly magnet spring 40*f*. The magnetic switch phase assembly 40 is sealed at the opposite end of the magnetic switch phase assembly contact element 40*a* by a magnetic switch phase assembly housing end disk 40*i*.

Figure 2C:
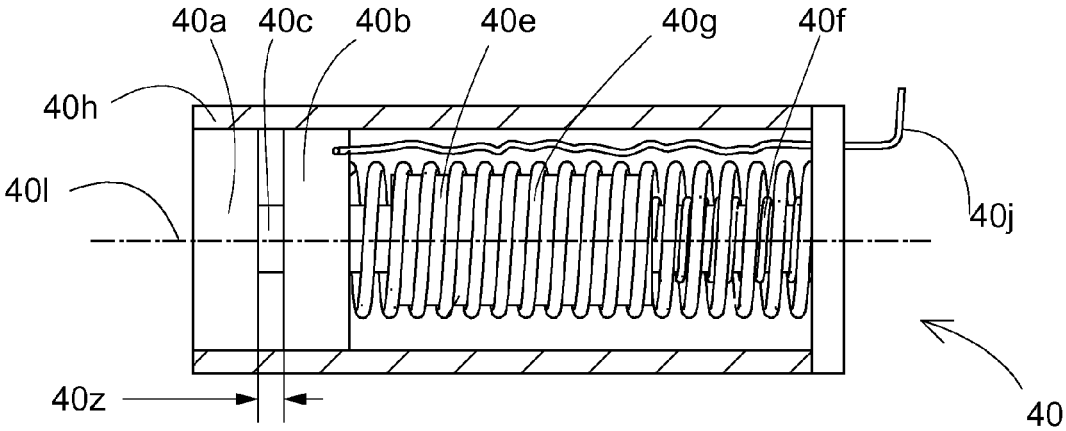
FIG. 2*c* is a partial cut-away side view schematic illustration of an exemplary, illustrative embodiment of a magnetic switch phase assembly, according to the present invention.

FIG. 2*c* is a partial cut-away side view schematic illustration of an exemplary, illustrative embodiment of a magnetic switch phase assembly 40, according to the present invention.

This figure depicts the magnetic switch phase wire 40*j*. In normal operation the magnetic switch phase assembly voltage element spring 40*g* ensures that there is a first gap 40*z* between the magnetic switch phase assembly contact element 40*a*, and the magnetic switch phase assembly voltage element 40*b*, such that there is no electrical contact between them. Should a suitable (and strong enough) magnetic force be applied to the magnetic switch phase assembly magnet 40*e* and to the magnetic switch phase assembly voltage element 40*b*, it will overcome the strength of the magnetic switch phase assembly magnet spring 40*f*, and the magnetic switch phase assembly voltage element spring 40*g*, creating a physical contact which enables an electrical current to flow between the magnetic switch phase assembly contact element 40*a*, and the magnetic switch phase assembly voltage element 40*b*.

Magnetic switch phase wire 40*j* can also be omitted, and the magnetic switch phase assembly voltage element spring 40*g* can be used as an electrical conductor in its place.

The magnetic switch phase assembly 40 can have a magnetic switch phase assembly symmetry axis 40*l*.

According to another embodiment of the present invention the magnetic switch phase assembly 40 includes no magnetic switch phase assembly magnet 40*e* and a suitable stronger magnetic force is applied to the magnetic switch phase assembly voltage element 40*b*, at the proper time.

Figure 2D:
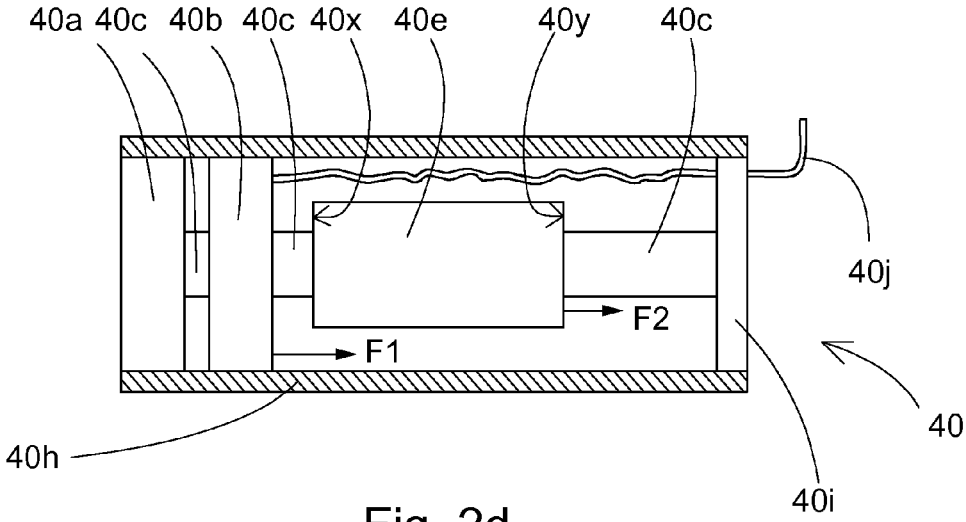
FIG. 2*d* is a partial cut-away side view schematic illustration of an exemplary, illustrative embodiment of a magnetic switch phase assembly, according to the present invention.

FIG. 2*d* is a partial cut-away side view schematic illustration of an exemplary, illustrative embodiment of a magnetic switch phase assembly 40, according to the present invention.

The illustration shows force F1 which applies to the magnetic switch phase assembly voltage element 40*b*, while so long as it is not over powered by an opposite force, there will be no contact between the magnetic switch phase assembly voltage element 40*b* and magnetic switch phase assembly contact element 40*a*, and force F2 which applies to the magnetic switch phase assembly magnet 40*e*, while only applying a stronger force in the opposite direction will enable movement of the magnetic switch phase assembly magnet 40*e* in the direction of the magnetic switch phase assembly voltage element 40*b*.

Despite including the word "phase" in the magnetic switch phase assembly 40 and related components' names, it is to be understood that this is not to limit the use of the present invention to be used with alternating current type of electricity, but it can be used with other types of electricity, such as direct current.

Figure 3A:
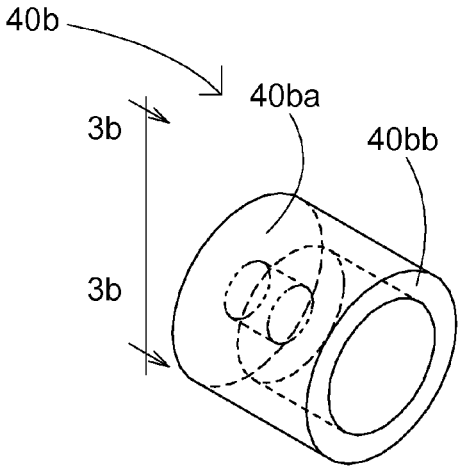
FIG. 3*a* is a perspective view schematic illustration of an exemplary, illustrative embodiment of a magnetic switch phase assembly voltage element, according to the present invention, upon which the section plane 3*b*-3*b* is marked.

FIG. 3*a* is a perspective view schematic illustration of an exemplary, illustrative embodiment of a magnetic switch phase assembly voltage element 40*b*, according to the present invention, upon which the section plane 3*b*-3*b* is marked.

This figure depicts a possible structure of the magnetic switch phase assembly voltage element 40*b*, which is shaped as a cylinder comprising of a magnetic switch phase assembly voltage element base 40*ba*, and a magnetic switch phase assembly voltage element wall 40*bb*, allowing for the best possible movement within the magnetic switch phase assembly housing 40*h*.

Figure 3B:
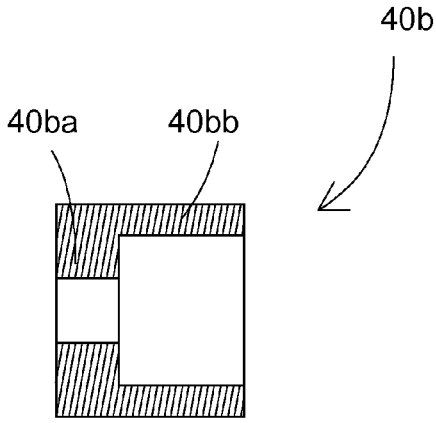
FIG. 3*b* is a cross sectional side view 3*b*-3*b* schematic illustration of an exemplary, illustrative embodiment of the magnetic switch phase assembly voltage element, according to the present invention.

FIG. 3*b* is a cross sectional side view 3*b*-3*b* schematic illustration of an exemplary, illustrative embodiment of the magnetic switch phase assembly voltage element 40*b*, according to the present invention.

Figure 4A:
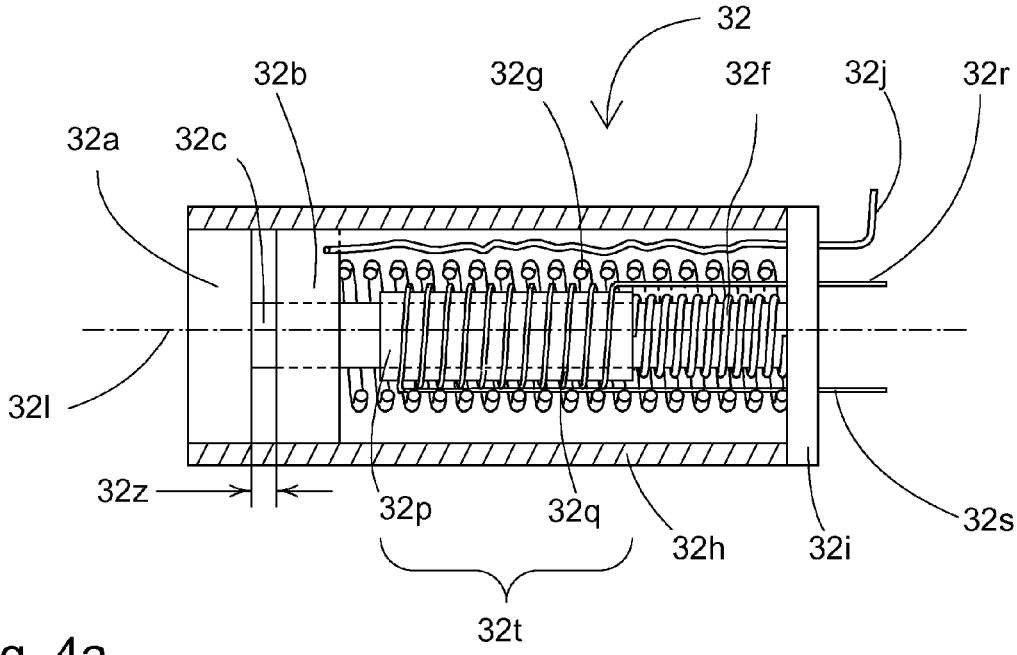
FIG. 4*a* is a partial cut-away side view schematic illustration of an exemplary, illustrative embodiment of an electromagnetic switch assembly, according to the present invention.

FIG. 4*a* is a partial cut-away side view schematic illustration of an exemplary, illustrative embodiment of an electromagnetic switch assembly 32, according to the present invention.

The structure of the electromagnetic switch assembly 32 is mostly similar to the structure of magnetic switch phase assembly 40, (not shown in the present illustration), other than one main difference. The electromagnetic switch assembly 32 has no magnetic switch phase assembly magnet 40*e*, (not shown in the present illustration), but instead has an electromagnetic switch assembly electromagnet 32*t*, which includes an electromagnetic switch assembly electromagnet core 32*p* and an electromagnetic switch assembly electromagnet coil 32*q*, whose ends have an electromagnetic switch assembly electromagnet coil first pin 32*r* and an electromagnetic switch assembly electromagnet coil second pin 32*s*. Also, instead of a magnetic switch phase wire 40*j*, (not shown in the present illustration), there is an electromagnetic switch assembly voltage element wire 32*j*.

The electromagnet functions as a magnet and provides a magnetic force whose power and direction depends upon the electrical current conducted through the electromagnetic switch assembly electromagnet coil 32*q*, when there is such a current.

The electromagnetic switch assembly 32 also includes an electromagnetic switch assembly shaft 32*c*, an electromagnetic switch assembly voltage element 32*b*, an electromagnetic switch assembly contact element 32*a*, an electromagnetic switch assembly voltage element spring 32*g*, an electromagnetic switch assembly electromagnet spring 32*f*, an electromagnetic switch assembly housing 32*h*, and an electromagnetic switch assembly housing end disk 32*i*. The electromagnetic switch assembly 32 can have an electromagnetic switch assembly symmetry axis 32*l*.

In normal operation the electromagnetic switch phase assembly voltage element spring 32*g* ensures that there is a second gap 32*z* between the electromagnetic switch phase assembly contact element 32*a*, and the electromagnetic switch phase assembly voltage element 32*b*, such that there is no electrical contact between them.

Figure 4B:
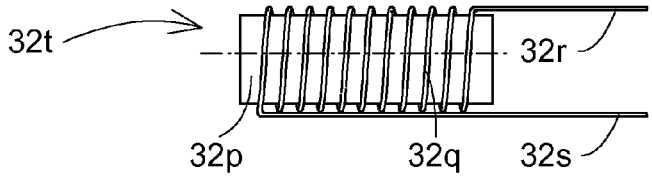
FIG. 4*b* is a side view schematic illustration of an exemplary, illustrative embodiment of an electromagnetic switch assembly electromagnet, according to the present invention.

FIG. 4*b* is a side view schematic illustration of an exemplary, illustrative embodiment of an electromagnetic switch assembly electromagnet 32*t*, according to the present invention.

The electromagnetic switch assembly electromagnet 32*t* contains an electromagnetic switch assembly electromagnet core 32*p* surrounded by an electromagnetic switch assembly electromagnet coil 32*q* which has an electromagnetic switch assembly electromagnet coil first pin 32*r* and an electromagnetic switch assembly electromagnet coil second pin 32*s*. Upon applying direct current through the electromagnetic switch assembly electromagnet coil 32*q*, the electromagnetic switch assembly electromagnet core 32*p* is magnetized in a specific polarity determined by the direction of the current flowing through the electromagnetic switch assembly electromagnet coil 32*q*.

Figure 5A:
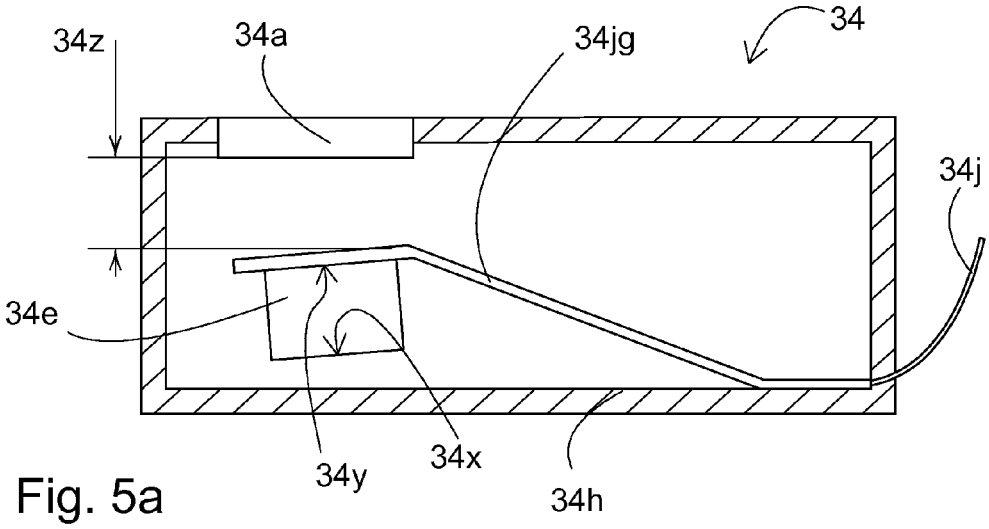
FIG. 5*a* is a partial cut-away side view schematic illustration of an exemplary, illustrative embodiment of a cantilever version of a magnetic switch assembly, according to the present invention.

FIG. 5*a* is a partial cut-away side view schematic illustration of an exemplary, illustrative embodiment of a cantilever version of a magnetic switch assembly 34, according to the present invention.

In the cantilever version of the magnetic switch, the cantilever version of a magnetic switch assembly voltage element wire and assembly voltage element spring 34*jg* is used to conduct electricity from the cantilever version of a magnetic switch assembly wire 34*j* to the cantilever version of a magnetic switch assembly contact element 34*a* (when engaged) as well as to move the cantilever version of a magnetic switch assembly magnet 34*e* away from the cantilever version of a magnetic switch assembly contact element 34*a* when it is not engaged, and form a third gap 34*z*.

The cantilever version of a magnetic switch assembly magnet 34*e* has a cantilever version of a magnetic switch assembly magnet first magnetic pole 34*x* and a cantilever version of a magnetic switch assembly magnet second magnetic pole 34*y* just as in the magnetic switch phase assembly 40 (not shown in the present figure).

It is possible to affix the cantilever version of a magnetic switch assembly magnet 34*e* in the opposite orientation to the one presented in the present figure, thereby creating a cantilever version of the magnetic switch zero assembly 41 (not shown in the present figure).

The cantilever version of a magnetic switch 34 is enclosed in a cantilever version of a magnetic switch assembly housing 34*h*.

Figure 5B:
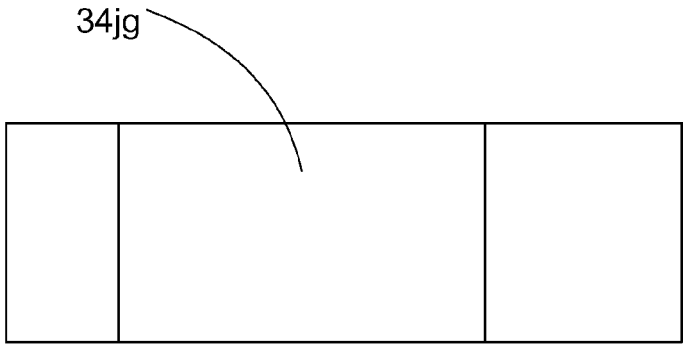
FIG. 5*b* is a top view schematic illustration of an exemplary, illustrative embodiment of a cantilever version of a magnetic switch assembly voltage element wire and assembly voltage element spring, according to the present invention.

FIG. 5*b* is a top view schematic illustration of an exemplary, illustrative embodiment of a cantilever version of a magnetic switch assembly voltage element wire and assembly voltage element spring 34*jg*, according to the present invention.

The cantilever version of a magnetic switch assembly voltage element wire and assembly voltage element spring 34*jg* is made of a flexible material that can bend towards the cantilever version of a magnetic switch assembly contact element 34*a* and back during normal operation.

Figure 6:
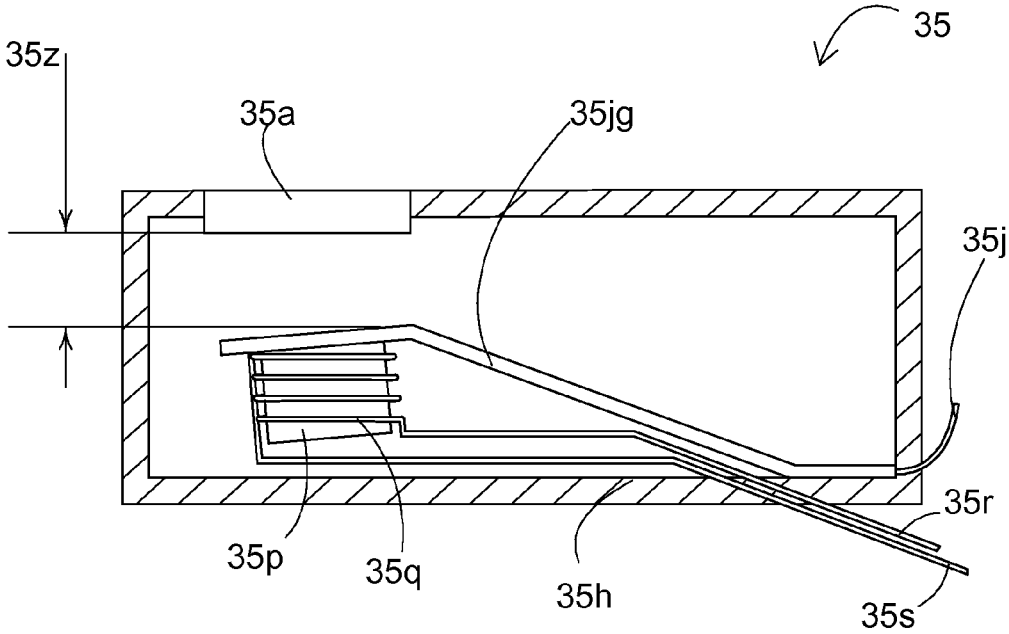
FIG. 6 is a partial cut-away side view schematic illustration of an exemplary, illustrative embodiment of a cantilever version of an electro-magnetic switch assembly, according to the present invention.

FIG. 6 is a partial cut-away side view schematic illustration of an exemplary, illustrative embodiment of a cantilever version of an electro-magnetic switch assembly, according to the present invention 35.

The operating concept of cantilever version of an electromagnetic switch assembly 35 is the same as in the cantilever version of a magnetic switch 34, (not shown in the present illustration).

However, in this instance, the cantilever version of a magnetic switch assembly magnet 34*e*, (not shown in the present illustration), is replaced by a cantilever version of electromagnetic switch assembly electromagnet coil 35*q* (which has a cantilever version of electro-magnetic switch assembly electromagnet coil first pin 35*r* and cantilever version of electro-magnetic switch assembly electromagnet coil second pin 35*s*) and a cantilever version of electro-magnetic switch assembly core 35*p*.

The cantilever version of an electro-magnetic switch assembly 35 is enclosed in the cantilever version of electromagnetic switch assembly housing 35*h* and includes a cantilever version of electro-magnetic switch assembly contact element 35*a*.

Figure 7A:
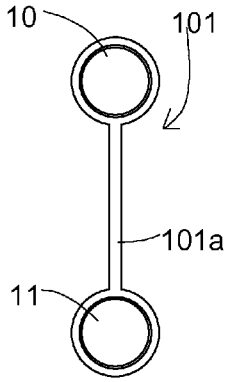
FIG. 7*a* is a front view schematic illustration of an exemplary, illustrative embodiment of planar stationary unit set, according to the present invention.

FIG. 7*a* is a front view schematic illustration of an exemplary, illustrative embodiment of planar stationary unit set 101, according to the present invention.

The planar stationary unit set 101 according to the illustrative embodiment of the present illustration includes a planar stationary unit phase assembly 10, and a planar stationary unit zero assembly 11 which are both encased in a planar stationary unit set body 101*a*.

In the case described in the figure, the planar stationary unit phase assembly 10, and the planar stationary unit zero assembly 11 cross sections are circular, but other shapes are possible as well.

Figure 7B:
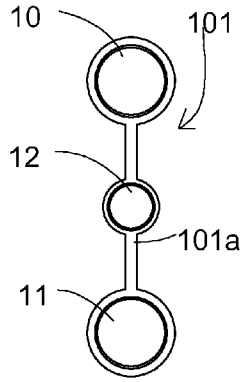
FIG. 7*b* is a front view schematic illustration of an exemplary, illustrative embodiment of planar stationary unit set, according to the present invention.

FIG. 7*b* is a front view schematic illustration of an exemplary, illustrative embodiment of planar stationary unit set 101, according to the present invention.

The planar stationary unit set 101 according to the illustrative embodiment of the present illustration includes a planar stationary unit phase assembly 10, a planar stationary unit zero assembly 11 and a planar stationary unit ground element 12, all the three are enclosed in a planar stationary unit set body 101*a*.

In the case described in the figure, the planar stationary unit phase assembly 10, the planar stationary unit ground element 12, and the planar stationary unit zero assembly 11 cross sections are circular, but other shapes are possible as well.

Figure 8:
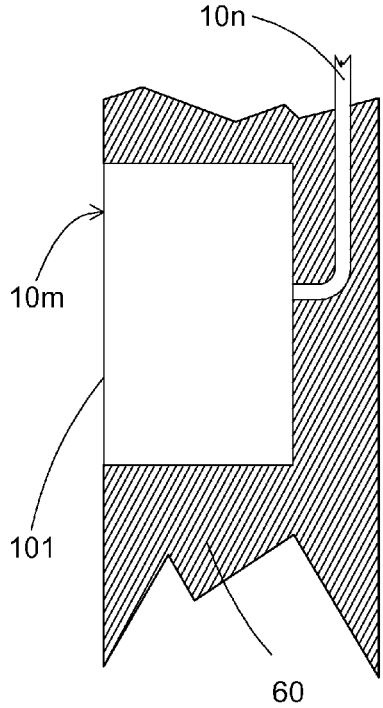
FIG. 8 is a side view schematic illustration of an exemplary, illustrative embodiment of planar stationary unit set, embedded within the non-conductive matrix, such as a building wall, according to the present invention.

FIG. 8 is a side view schematic illustration of an exemplary, illustrative embodiment of planar stationary unit set 101, embedded within the non-conductive matrix 60, such as a building wall, according to the present invention.

Pipe 10*n* may serve for securing and protecting the electrical wires connecting the power supply grid to the planar stationary unit set 101. The planar stationary unit set 101 have a planar surface 10*m*.

Figure 9A:
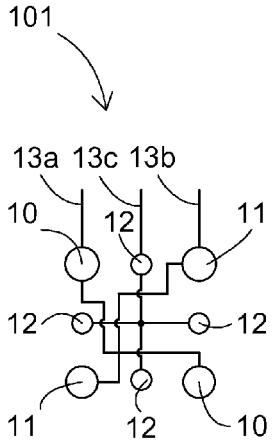
FIG. 9*a* is a top view schematic illustration of an exemplary, illustrative embodiment of the planar stationary unit set, including several planar stationary unit phase switch assemblies, planar stationary unit ground elements, and planar stationary unit zero assemblies, arranged in a matrix as described in the figure, where round cross section are used, according to the present invention.

FIG. 9*a* is a top view schematic illustration of an exemplary, illustrative embodiment of the planar stationary unit set 101, including several planar stationary unit phase assemblies 10, several planar stationary unit ground elements 12, and several planar stationary unit zero assemblies 11, arranged in a matrix as described in the figure, with round cross section are used, according to the present invention.

In this figure, it is possible to see the electrical connections of the different phase and zero assemblies to their corresponding power supplies. The planar stationary unit phase assemblies 10 are connected to a planar stationary unit phase power supply 13*a*, the planar stationary unit ground elements 12 are connected to a planar stationary unit ground 13*c* and the planar stationary unit zero assemblies 11 are connected to a planar stationary unit zero power supply 13*b*.

Figure 9B:
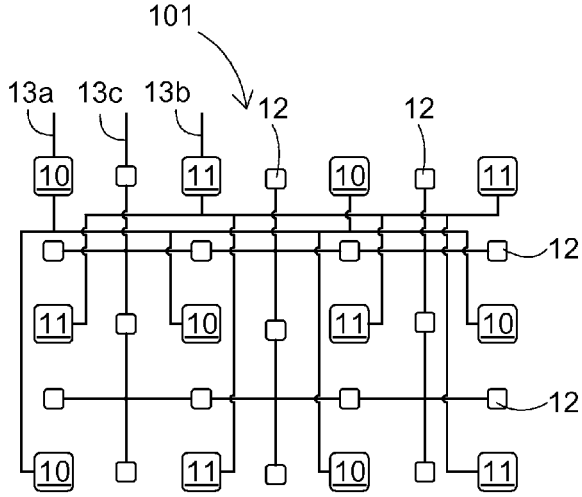
FIG. 9*b* is a top view schematic illustration of an exemplary, illustrative embodiment of the planar stationary unit set, including several planar stationary unit phase switch assemblies, planar stationary unit ground elements, and planar stationary unit zero assemblies, arranged in a matrix as described in the figure, where square cross section are used, according to the present invention.

FIG. 9*b* is a top view schematic illustration of an exemplary, illustrative embodiment of the planar stationary unit set 101, including several planar stationary unit phase assemblies 10, several planar stationary unit ground elements 12, and several planar stationary unit zero assemblies 11, arranged in a matrix as described in the figure, with square cross section are used, according to the present invention.

In this figure, it is possible to see the electrical connections of the different phase and zero assemblies to their corresponding power supplies. The planar stationary unit phase assemblies 10 are connected to the planar stationary unit phase power supply 13*a*, the planar stationary unit ground elements 12 are connected to the planar stationary unit ground 13*c* and the planar stationary unit zero assemblies 11 are connected to the planar stationary unit zero power supply 13*b*.

Figure 10A:
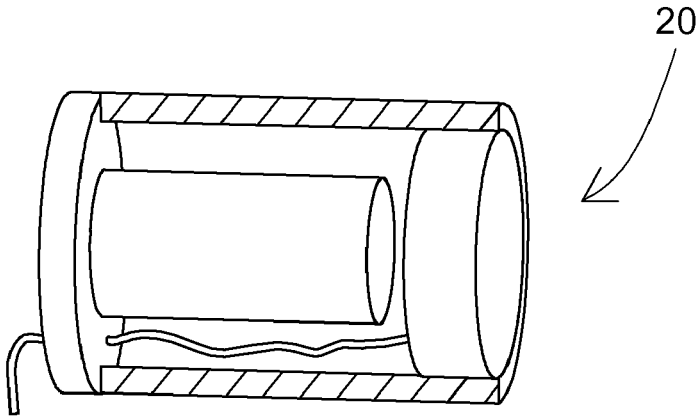
FIG. 10*a* is a partial cut-away isometric view schematic illustration of an exemplary, illustrative embodiment of a mobile unit phase assembly according to the present invention.

FIG. 10*a* is a partial cut-away isometric view schematic illustration of an exemplary, illustrative embodiment of a mobile unit phase assembly 20 according to the present invention.

Figure 10B:
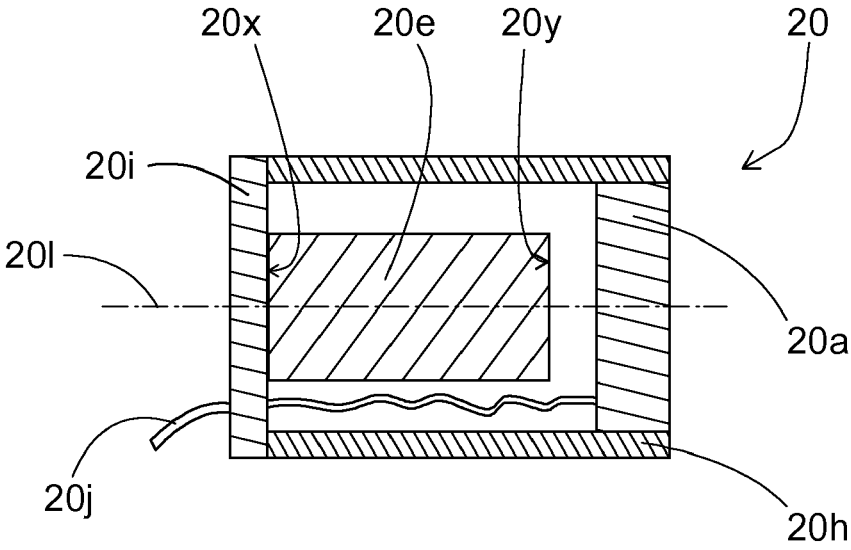
FIG. 10*b* is a cross sectional side view schematic illustration of an exemplary, illustrative embodiment of a mobile unit phase assembly, according to the present invention.

FIG. 10*b* is a cross sectional side view schematic illustration of an exemplary, illustrative embodiment of a mobile unit phase assembly 20, according to the present invention.

The mobile unit phase assembly 20 can have a mobile unit phase assembly symmetry axis 201.

A mobile unit phase assembly housing 20*h* including inside of it, a mobile unit phase assembly magnet 20*e* which has a mobile unit phase assembly magnet first magnetic pole 20*x*, and a mobile unit phase assembly magnet second magnetic pole 20*y* and is sealed in the back by a mobile unit phase assembly housing end disk 20*i* and in the front by a mobile unit assembly phase assembly contact element 20*a*, used to receive an electrical current from a planar stationary unit phase assembly 10, (not shown in the present illustration), to which a mobile unit phase assembly wire 20*j* is connected.

Figure 11A:
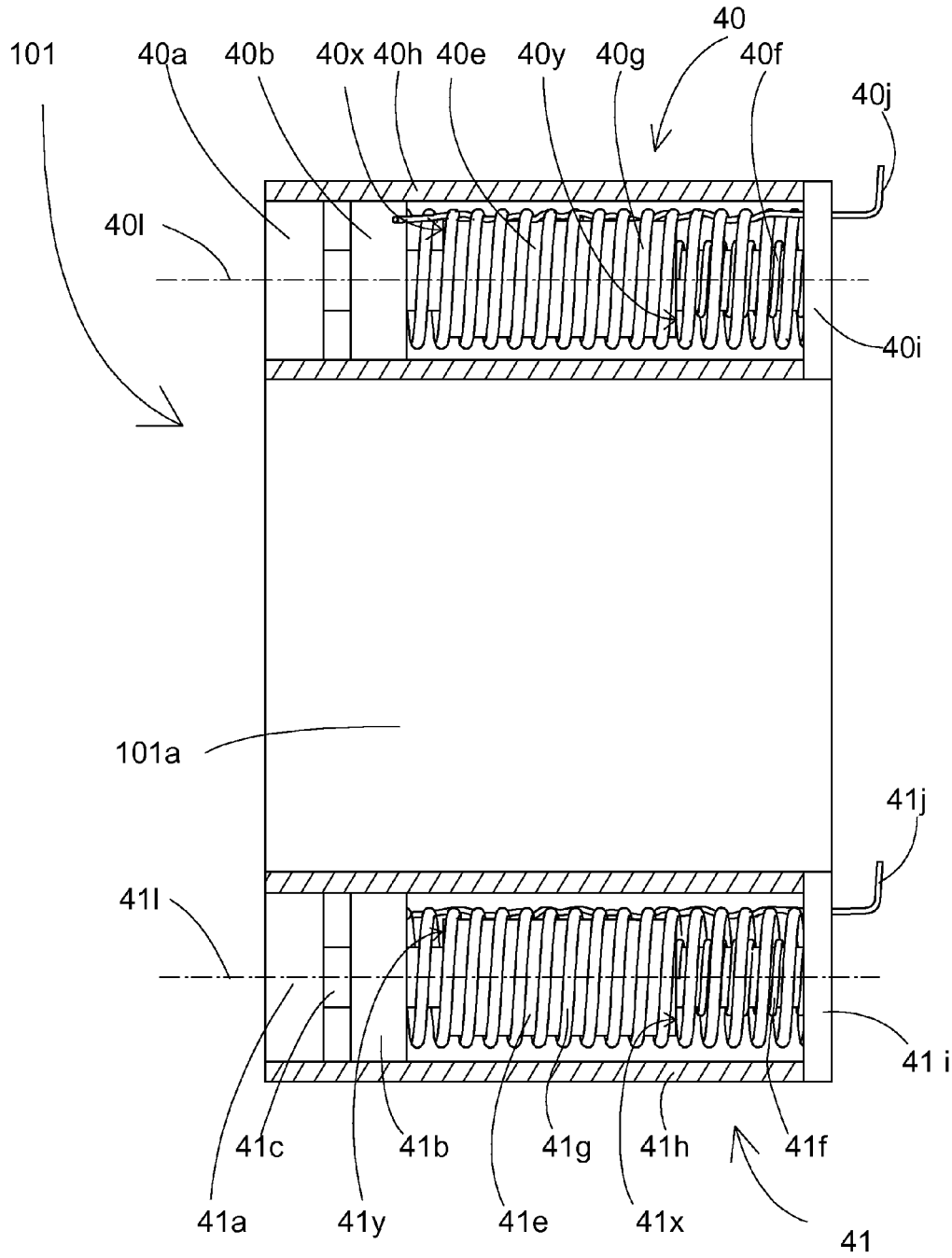
FIG. 11*a* is a partial cut-away side view schematic illustration of an exemplary illustrative embodiment of a planar stationary unit set according to the present invention.

FIG. 11*a* is a partial cut-away side view schematic illustration of an exemplary illustrative embodiment of a planar stationary unit set 101 according to the present invention.

The planar stationary unit set 101 includes a planar stationary unit set body 101*a*, a magnetic switch phase assembly 40, which is connected to a magnetic switch phase wire 40*j* and a magnetic switch zero assembly 41, which is connected to a magnetic switch zero wire 41*j*. The magnetic switch phase assembly 40 and the magnetic switch zero assembly 41 are located in a single plane and encased in to the a planar stationary unit set body 101*a*.

The magnetic switch zero assembly 41 can have a magnetic switch zero assembly symmetry axis 41*l*.

The magnetic switch zero assembly contact element 41*a*, magnetic switch zero assembly voltage element 41*b*, magnetic switch zero assembly shaft 41*c*, magnetic switch zero assembly magnet 41*e*, magnetic switch zero assembly magnet spring 41*f*, magnetic switch zero assembly voltage element spring 41*g*, magnetic switch zero assembly housing 41*h*, magnetic switch zero assembly magnet first magnetic pole 41*x*, and magnetic switch zero assembly magnet second magnetic pole 41*y*, function in the same manner in the magnetic switch zero assembly 41 to the magnetic switch phase assembly contact element 40*a*, magnetic switch phase assembly voltage element 40*b*, magnetic switch phase switch assembly shaft 40*c*, magnetic switch phase assembly magnet 40*e*, magnetic switch phase assembly magnet spring 40*f*, magnetic switch phase assembly voltage element spring 40*g*, magnetic switch phase assembly housing 40*h*, magnetic switch phase assembly magnet first magnetic pole 40*x*, and magnetic switch phase assembly magnet second magnetic pole 40*y*, in the structure and operation of the magnetic switch phase assembly 40, respectively.

Figure 11B:
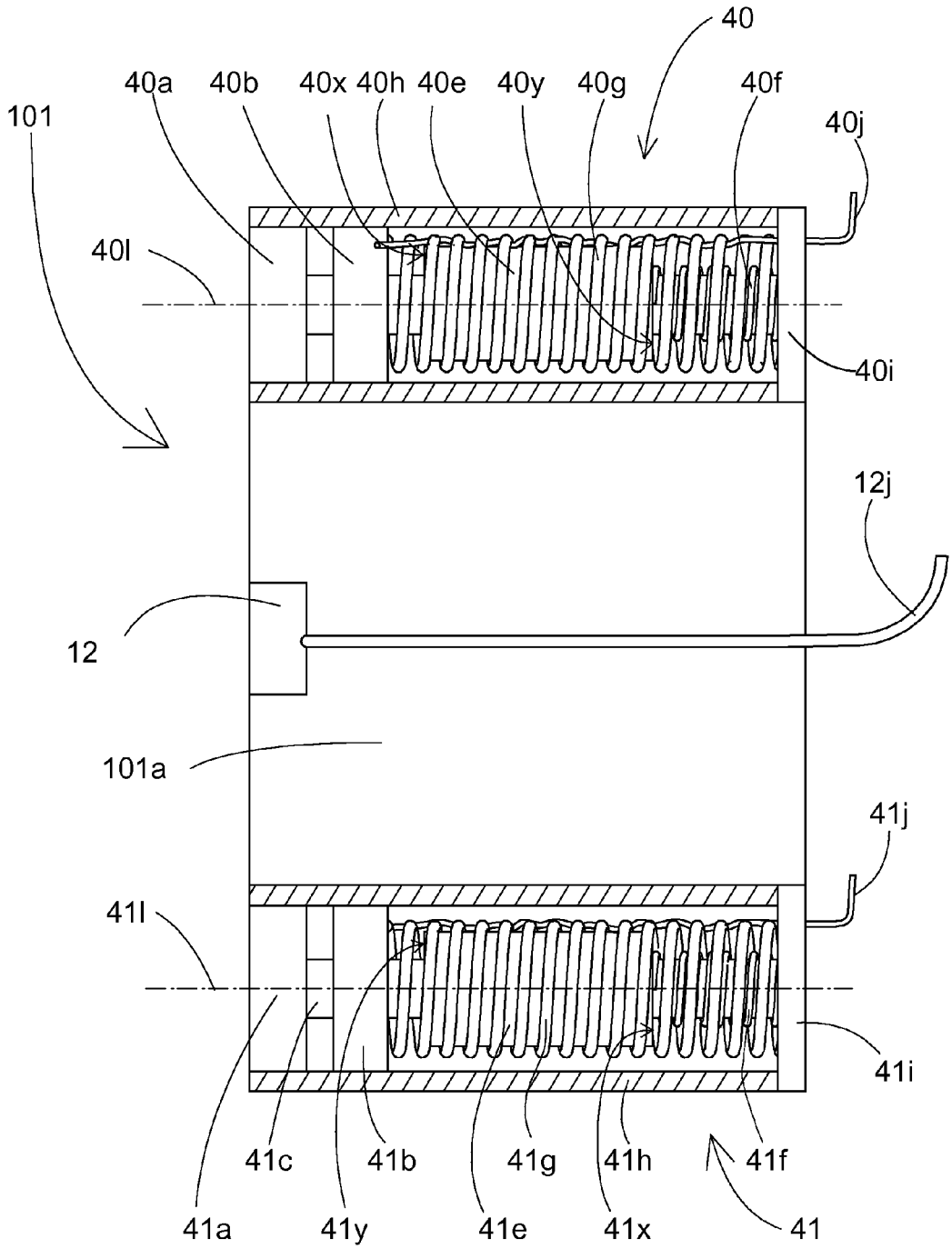
FIG. 11*b* is a partial cut-away view schematic illustration of an exemplary, illustrative embodiment of a planar stationary unit set, according to the present invention.

FIG. 11*b* is a partial cut-away view schematic illustration of an exemplary, illustrative embodiment of a planar stationary unit set 101, according to the present invention.

The planar stationary unit set 101 includes a magnetic switch phase assembly 40 which is connected to magnetic switch phase wire 40*j* and a magnetic switch zero assembly 41, which is connected to a magnetic switch zero wire 41*j*. The magnetic switch phase assembly 40 and the magnetic switch zero assembly 41 are located on a single plane, as seen in the figure, and each at the same distance from a planar stationary unit ground element 12, which is connected to a planar stationary unit ground element wire 12*j*.

The magnetic switch phase assembly 40 includes a magnetic switch phase assembly magnet first magnetic pole 40*x*, (for example, north pole) and a magnetic switch phase assembly magnet second magnetic pole 40*y*, (for example, south pole) which are in of opposite polarity to the magnetic switch zero assembly magnet first magnetic pole 41*x*, (for example, north pole) and the magnetic switch zero assembly magnet second magnetic pole 41*y*, (for example, south pole) of the magnetic switch zero assembly 41. The magnetic switch zero assembly 41 has a magnetic switch zero assembly shaft 41*c*, a magnetic switch zero assembly voltage element 41*b*, a magnetic switch zero assembly contact element 41*a*, a magnetic switch zero assembly magnet spring 41*f*, a magnetic switch zero assembly voltage element spring 41*g*, a magnetic switch zero assembly housing 41*h*, and a magnetic switch zero assembly housing end disk 41*i*, and can have a magnetic switch zero assembly symmetry axis 41*l*.

The magnetic switch phase assembly 40, the magnetic switch zero assembly 41, and the planar stationary unit ground element 12, are encased in to a planar stationary unit set body 101*a*.

Despite including the word "zero" in the magnetic switch zero assembly 11 and related components' names it is to be understood that this is not to limit the use of the present invention to be used with alternating current type of electricity, but it can be used with other types of electricity, such as direct current.

Figure 12A:
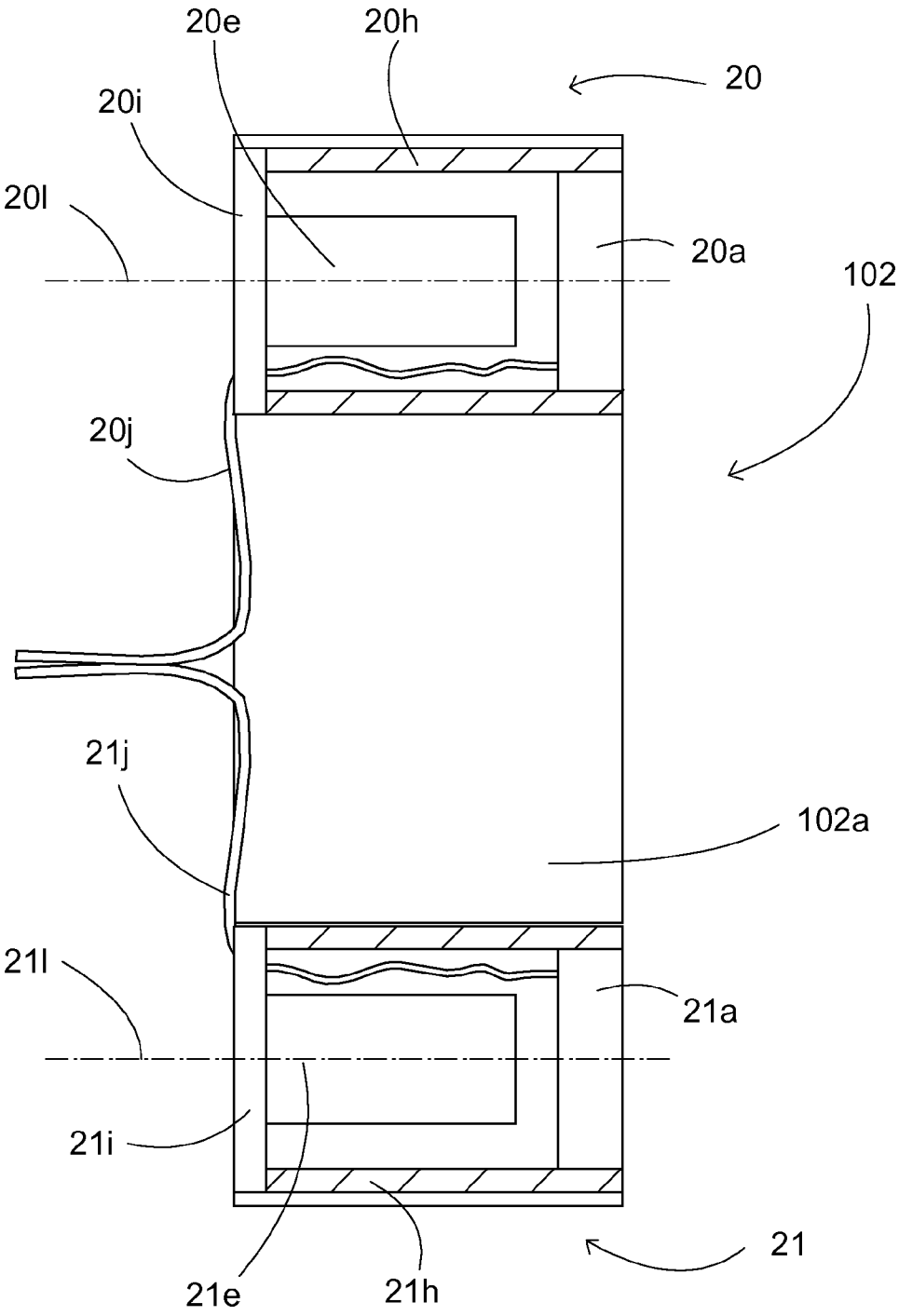
FIG. 12*a* is a partial cut-away side view schematic illustration of an exemplary, illustrative embodiment of a mobile unit set, according to the present invention.

FIG. 12*a* is a partial cut-away side view schematic illustration of an exemplary, illustrative embodiment of a mobile unit set 102, according to the present invention.

Mobile unit set 102 including the mobile unit phase assembly 20 and the mobile unit zero assembly 21.

The mobile unit zero assembly 21 has a mobile unit zero assembly contact element 21*a*, a mobile unit zero assembly magnet 21*e*, a mobile unit zero assembly housing 21*h*, a mobile unit zero assembly housing end disk 21*i*, and a mobile unit zero assembly wire 21*j*. The mobile unit zero assembly 21 can have a mobile unit zero assembly symmetry axis 21*l*.

The mobile unit phase assembly 20, and the mobile unit zero assembly 21 are both encased in a mobile unit set body 102*a*

Figure 12B:
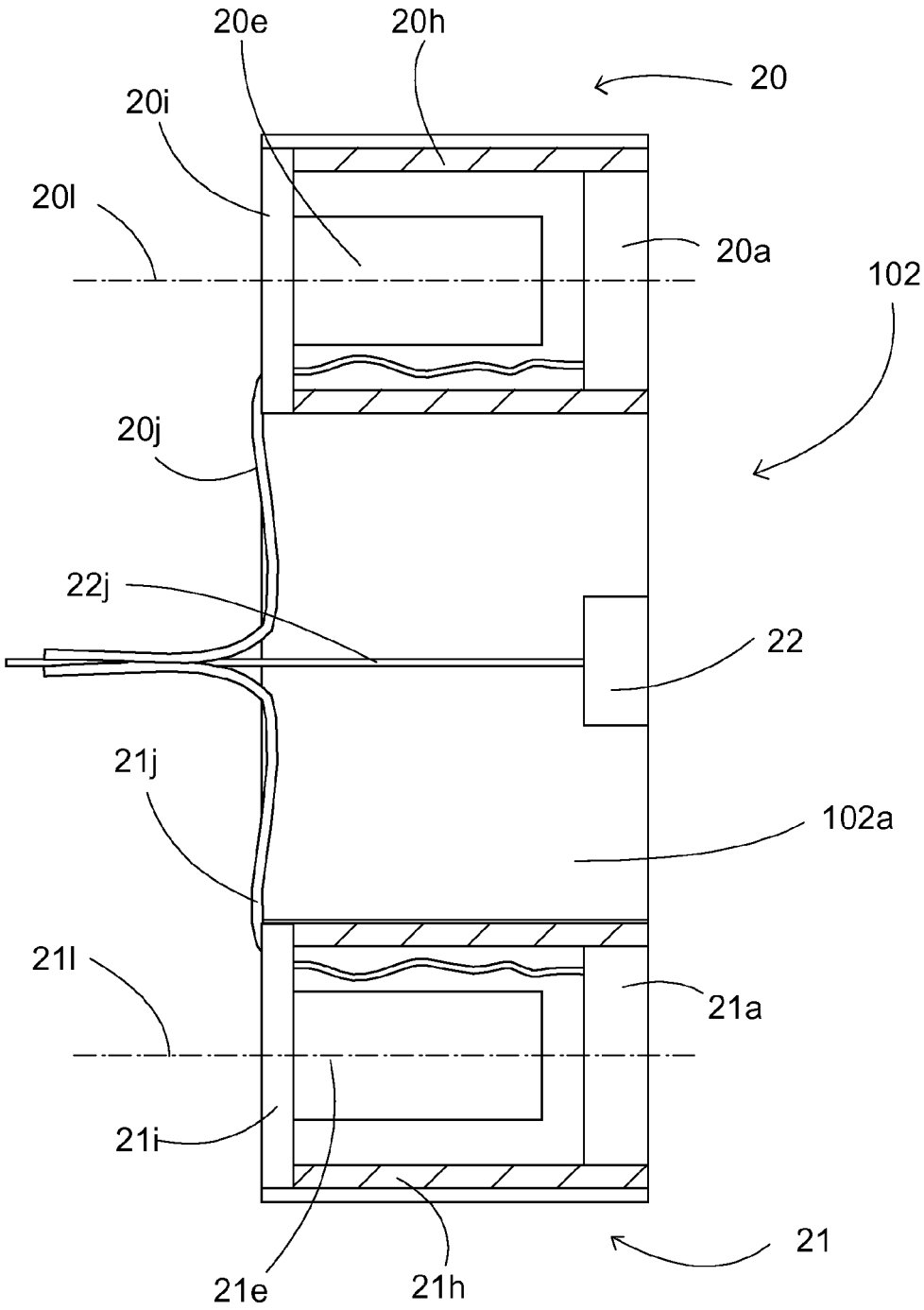
FIG. 12*b* is a partial cut-away side view schematic illustration of an exemplary, illustrative embodiment of a mobile unit set, according to the present invention.

FIG. 12*b* is a partial cut-away side view schematic illustration of an exemplary, illustrative embodiment of a mobile unit set 102, according to the present invention.

Mobile unit set 102 including the mobile unit phase assembly 20, the mobile unit zero assembly 21, and the mobile unit ground element 22, connected to mobile unit ground element wire 22*j*. The mobile unit zero assembly 21 has a mobile unit zero assembly contact element 21*a*, a mobile unit zero assembly magnet 21*e*, a mobile unit zero assembly housing 21*h*, a mobile unit zero assembly housing end disk 21*i*, and a mobile unit zero assembly wire 21*j*. The mobile unit zero assembly 21 can have mobile unit zero assembly symmetry axis 21*l*.

The mobile unit phase assembly 20, the mobile unit zero assembly 21, and the mobile unit ground element 22 are encased in a mobile unit set body 102*a*.

Figure 13A:
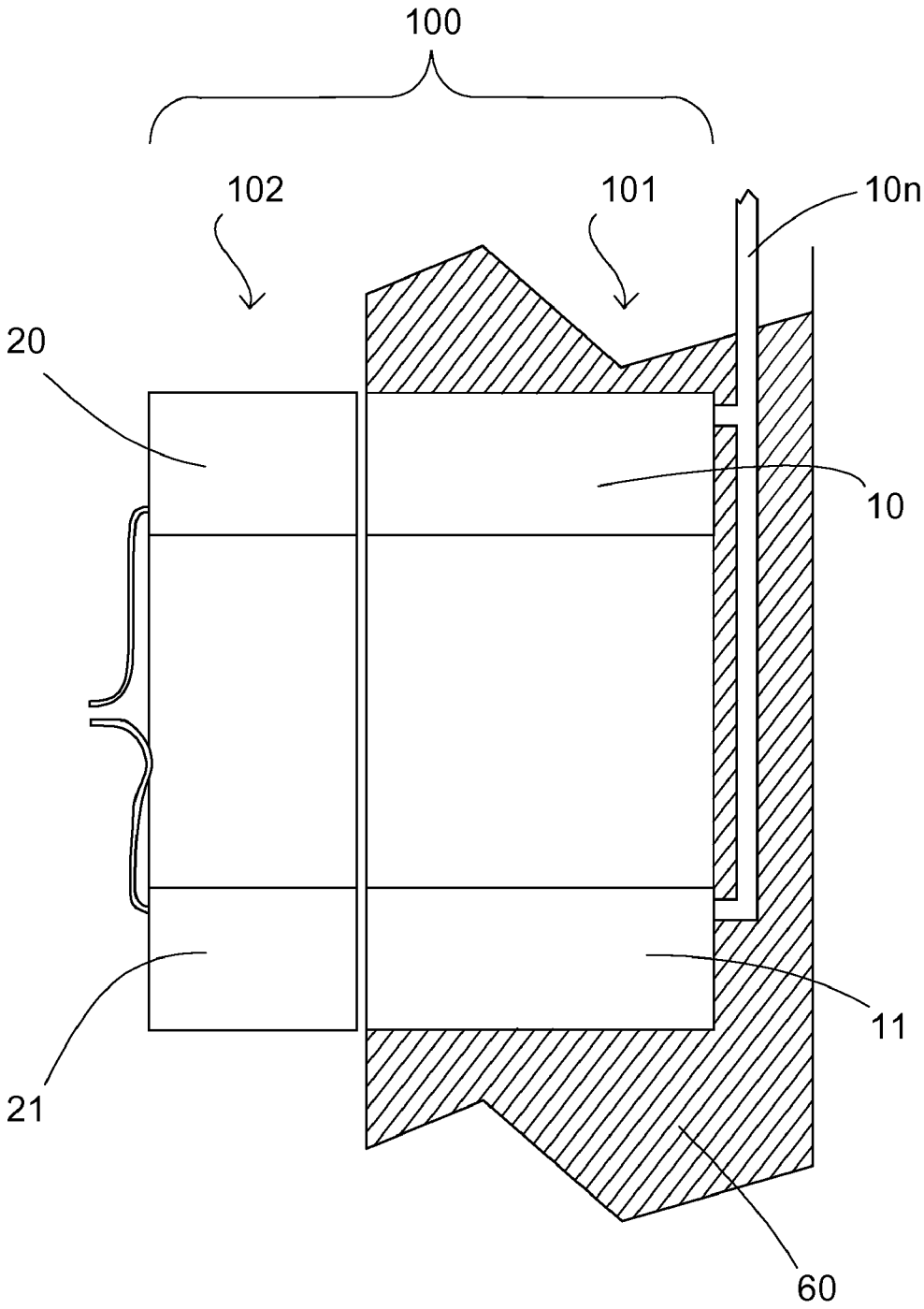
FIG. 13*a* is a partial cut-away side view schematic illustration of an exemplary, illustrative embodiment of an apparatus for transferring electrical power, according to the present invention.

FIG. 13*a* is a partial cut-away side view schematic illustration of an exemplary, illustrative embodiment of an apparatus for transferring electrical power 100, according to the present invention.

The planar stationary unit phase assembly 10 and the planar stationary unit zero assembly 11 being positioned aside one another.

The mobile unit phase assembly 20 and the mobile unit zero assembly 21 being positioned aside one another.

In the present illustration, it is possible to see that the mobile unit phase assembly 20 and the mobile unit zero assembly 21 are aligned with the planar stationary unit phase assembly 10, and the planar stationary unit zero assembly 11.

Figure 13B:
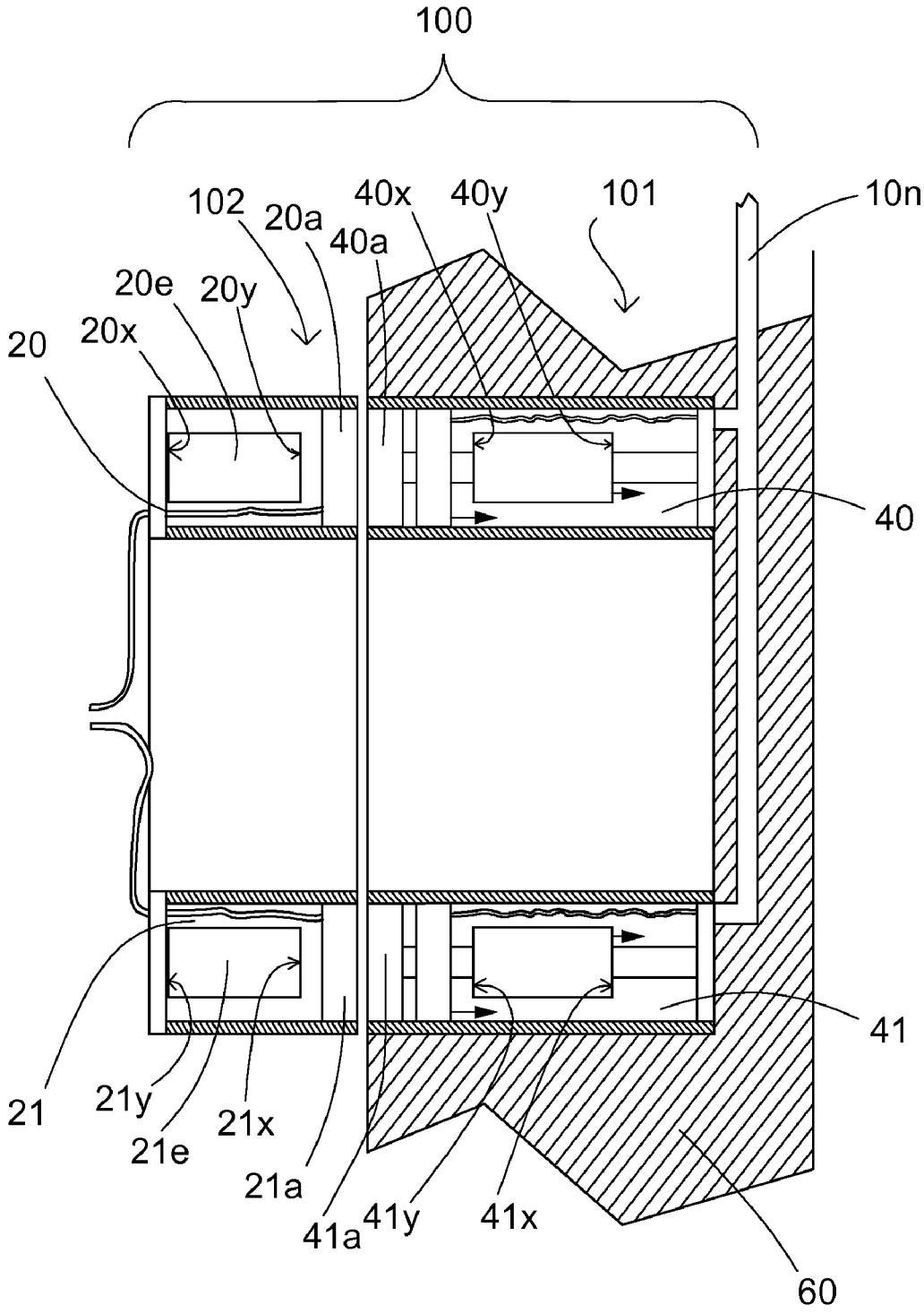
FIG. 13*b* is a partial cut-away side view schematic illustration of an exemplary, illustrative embodiment of an apparatus for transferring electrical power, according to the present invention.

FIG. 13*b* is a partial cut-away side view schematic illustration of an exemplary, illustrative embodiment of an apparatus for transferring electrical power 100, according to the present invention.

The present figure illustrates the use of a magnetic switch phase assembly 40 as a first type of a planar stationary unit phase assembly 10 and a magnetic switch zero assembly 41 as a first type of a planar stationary unit zero assembly 11.

Figure 13C:
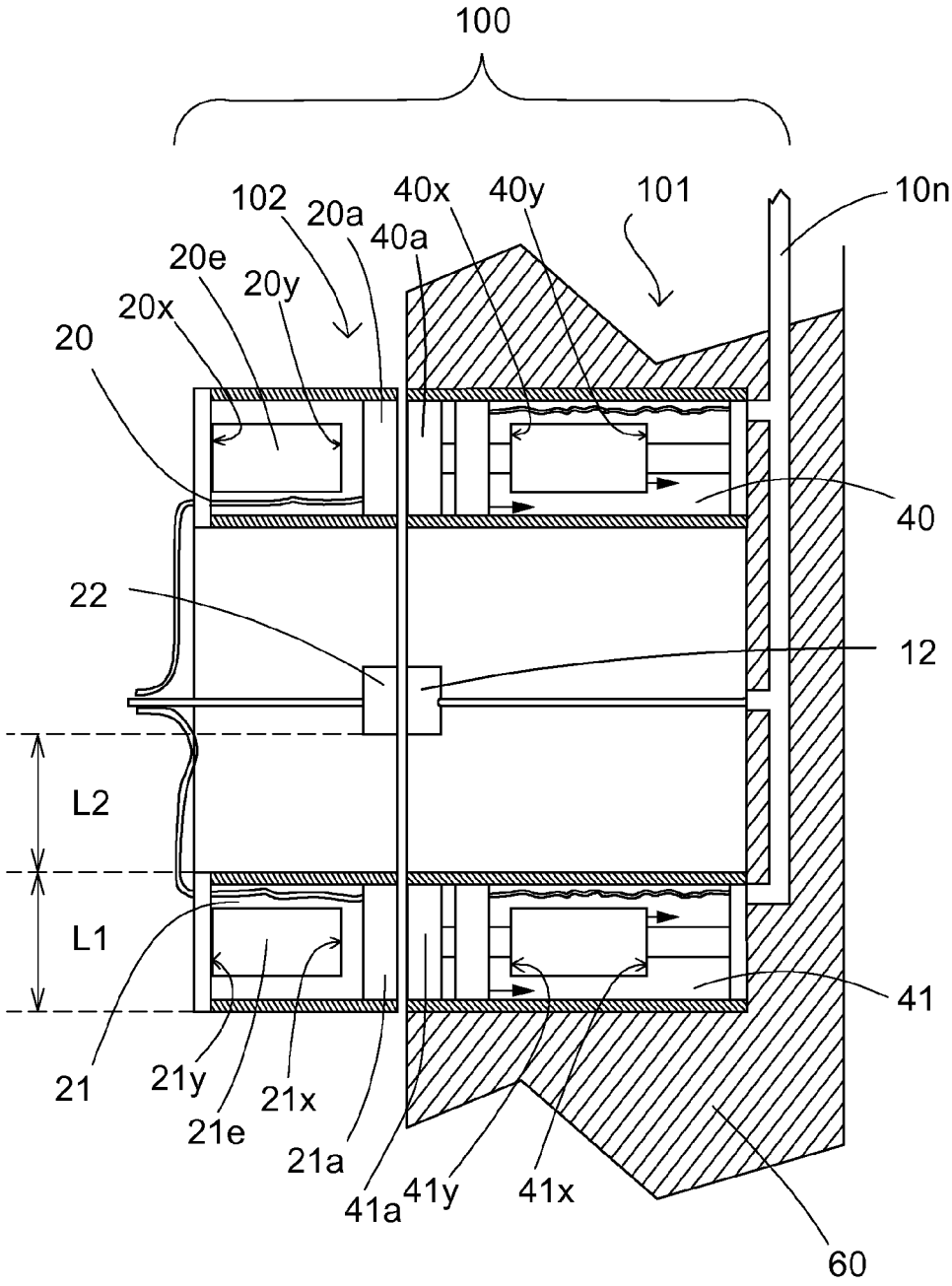
FIG. 13*c* is a partial cut-away view schematic illustration of an exemplary, illustrative embodiment of an apparatus for transferring electrical power, according to the present invention.

FIG. 13*c* is a partial cut-away view schematic illustration of an exemplary, illustrative embodiment of an apparatus for transferring electrical power 100, according to the present invention.

The figure shows the measure L1 representing the width of the mobile unit zero assembly 21, and L2, representing the distance between it and the mobile unit ground element 22.

This figure also shows the use of a planar stationary unit ground element 12 and a mobile unit ground element 22 in order to add grounding functionality to the operation of the apparatus for transferring electrical power 100.

Figure 13D:
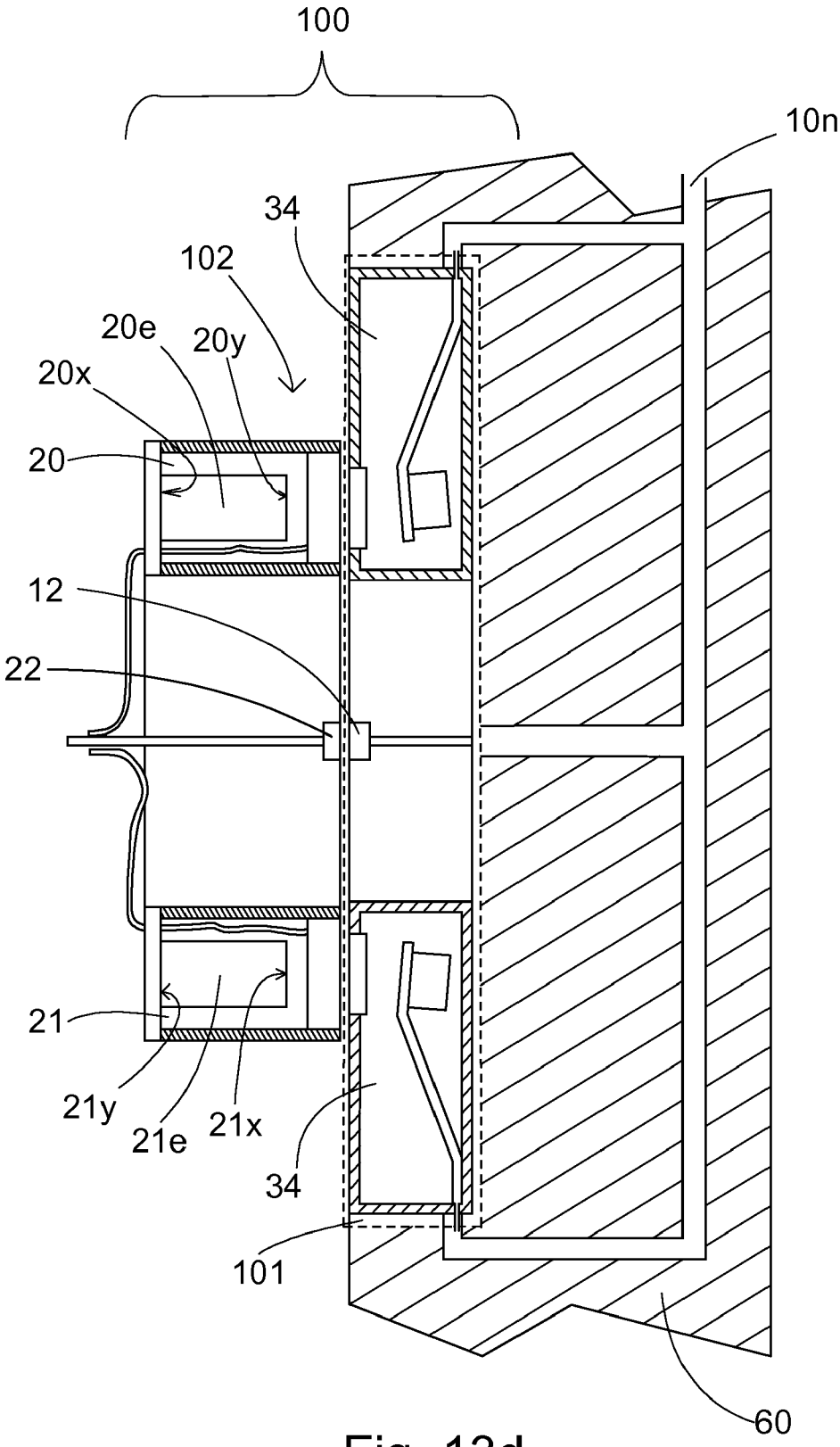
FIG. 13*d* is a partial cut-away side view schematic illustration of an exemplary, illustrative embodiment of an apparatus for transferring electrical power, according to the present invention.

FIG. 13*d* is a partial cut-away side view schematic illustration of an exemplary, illustrative embodiment of an apparatus for transferring electrical power 100, according to the present invention.

The present figure illustrates the use of a cantilever version of a magnetic switch assembly 34 as a second type of a planar stationary unit phase assembly 10 and a second type planar stationary unit zero assembly 11 (with a simple reversing of the cantilever version of a magnetic switch assembly magnet 34*e* in the cantilever version of a magnetic switch assembly 34 located opposite of the mobile unit phase assembly 20 and the mobile unit zero assembly 21).

This figure also shows the use of a planar stationary unit ground element 12 and a mobile unit ground element 22 in order to add grounding functionality to the operation of the apparatus for transferring electrical power 100.

Figure 13F:
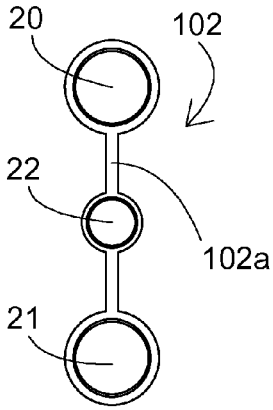
FIG. 13*f* is a front view schematic illustration of an exemplary, illustrative embodiment of mobile unit set, according to the present invention.
Figure 13E:
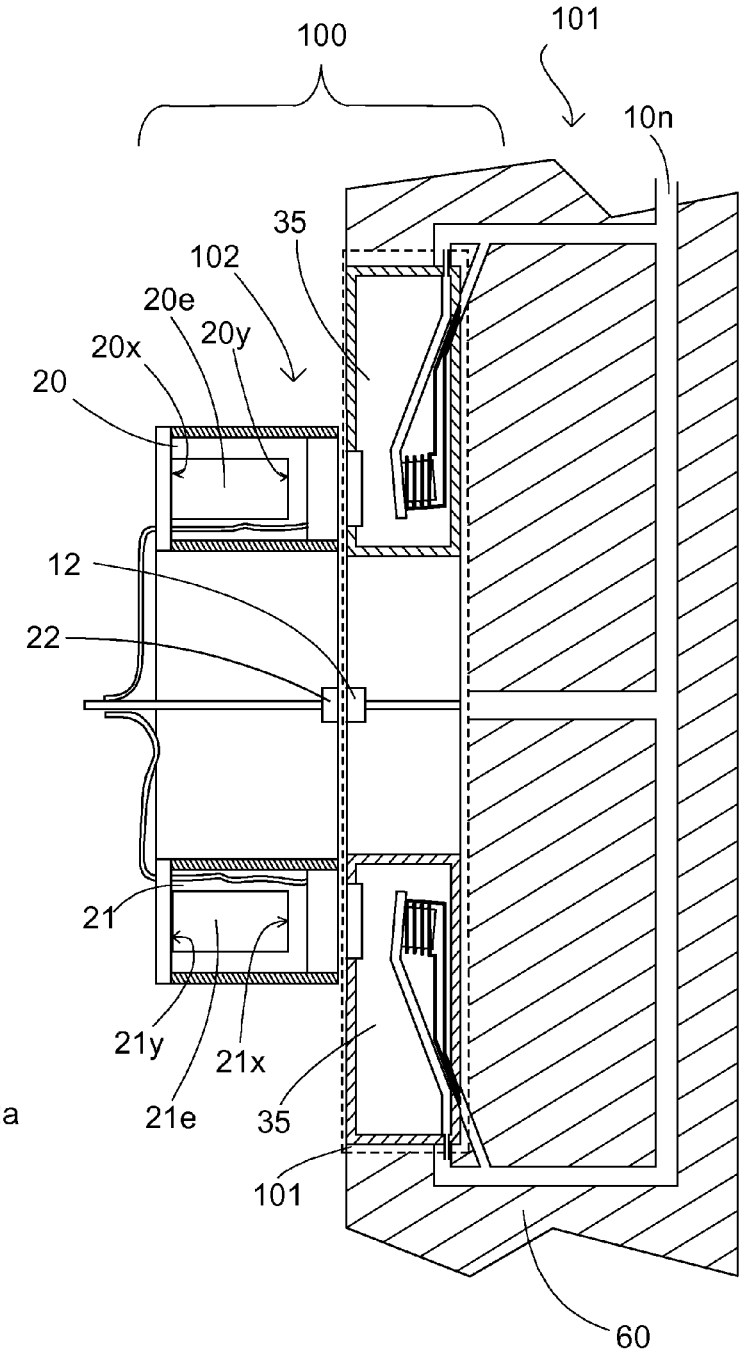
FIG. 13*e* is a partial cut-away view schematic illustration of an exemplary, illustrative embodiment of an apparatus for transferring electrical power according to the present invention.

FIG. 13*e* is a partial cut-away view schematic illustration of an exemplary, illustrative embodiment of an apparatus for transferring electrical power 100, according to the present invention.

The present figure illustrates the use a pair of cantilever version of electro-magnetic switch assemblies 35 as a third type of a planar stationary unit phase assembly 10 and a planar stationary unit zero assembly 11. The polarity of the electro-magnet within the cantilever version of electro-magnetic switch assemblies 35 is determined by the direction of the current flowing thorough the cantilever version of electro-magnetic switch assembly electromagnet coil 35*q*.

This figure also shows the use of a planar stationary unit ground element 12 and a mobile unit ground element 22 in order to add grounding functionality to the operation of the apparatus for transferring electrical power 100.

FIG. 13*f* is a front view schematic illustration of an exemplary, illustrative embodiment of mobile unit set 102, according to the present invention.

The mobile unit set 102 according to the illustrative embodiment of the present illustration includes a mobile unit phase assembly 20, a mobile unit zero assembly 21 and a mobile unit ground element 22, all the three are enclosed in a mobile unit set body 102*a*.

In the case described in the figure, the mobile unit phase assembly 20, the mobile unit zero assembly 21 and the mobile unit ground element 22 cross sections are circular, but other shapes are possible as well.

Figure 14A:
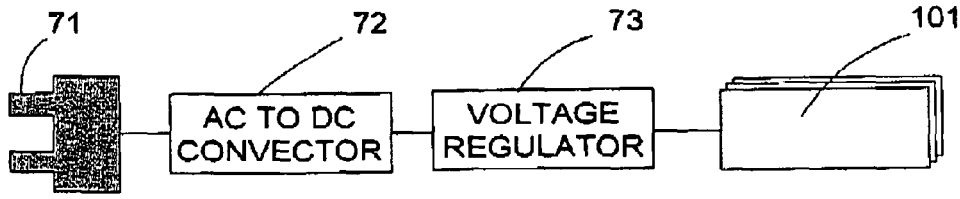
FIG. 14*a* is a schematic diagram of a means of supplying DC voltage to at least one planar stationary unit set, according to the present invention.

FIG. 14*a* is a schematic diagram of a means of supplying DC voltage to at least one planar stationary unit set 101, according to the present invention.

The mains outlet plug 71 is plugged into an electrical power supply socket (usually a standard wall power outlet) and the AC to DC converter 72 converts the power coming from the outlet (usually 110V/220V AC voltage) to a much lower DC voltage (usually, not more than 20-30V, but could be more or less than that). The planar stationary unit voltage regulator 73 is used to regulate and maintain a constant supply voltage to the at least one planar stationary unit set 101 even under high load currents.

Figure 14B:
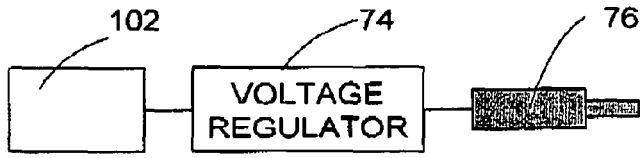
FIG. 14*b* is a schematic diagram of supplying DC voltage from a mobile unit set to a receiving portable electronic device's power plug, according to the present invention, using a mobile unit voltage regulator.

FIG. 14*b* is a schematic diagram of supplying the DC voltage from a mobile unit set 102, (not shown in the present illustration), to a receiving portable electronic device's power plug 76, according to the present invention, using a mobile unit voltage regulator 74.

The planar stationary unit sets 101 (not shown in the present illustration) supply a certain voltage level that may not fit the voltage requirements of the receiving electronic device. Therefore, it is required to regulate the incoming voltage to the appropriate voltage levels using the mobile unit voltage regulator 74.

Figure 15:
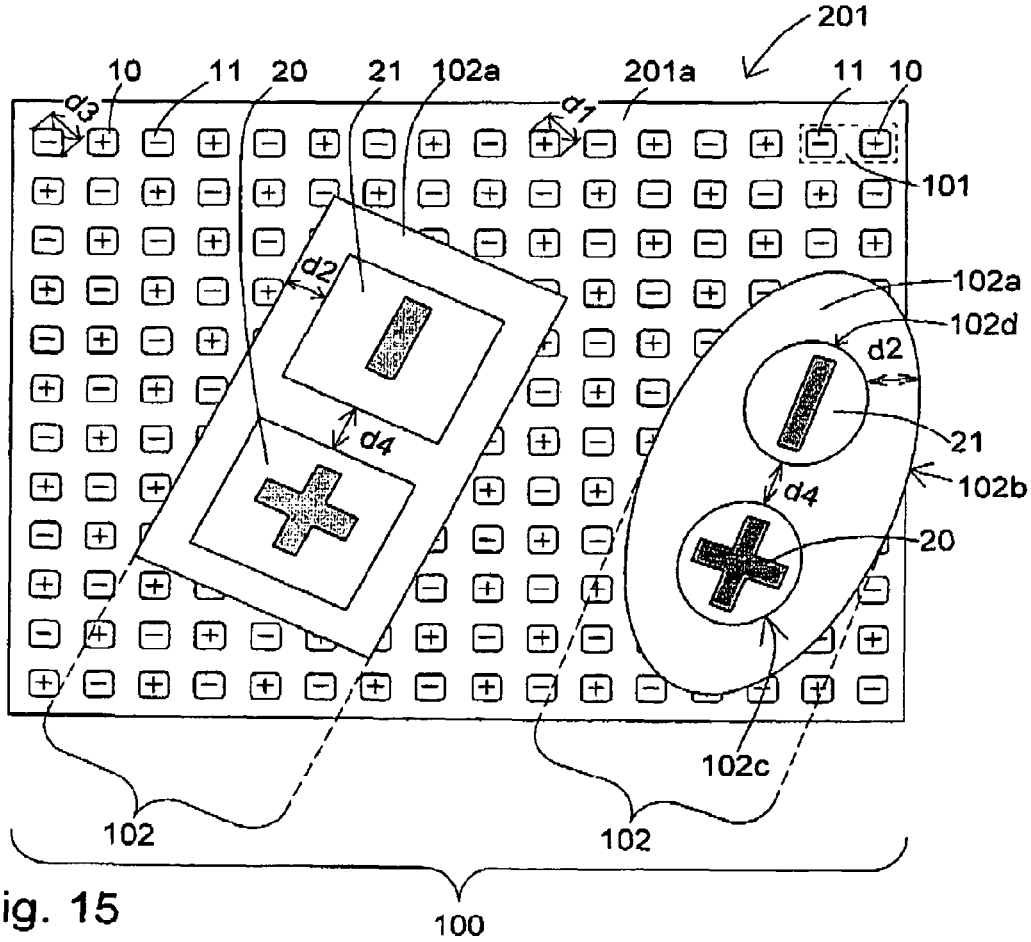
FIG. 15 is a top view schematic illustration of an exemplary, illustrative embodiment of an apparatus for transferring electrical power, according to the present invention; it also depicts several dimensions crucial to the safety of the apparatus for transferring electrical power, according to the present invention.
Figure 14A:
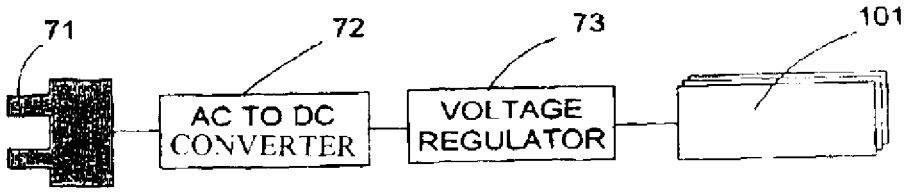
Figure 14B:
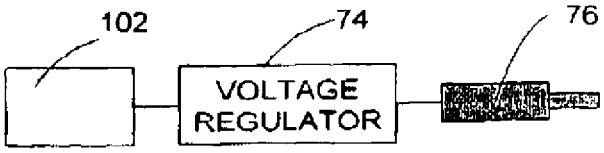
Figure 15:
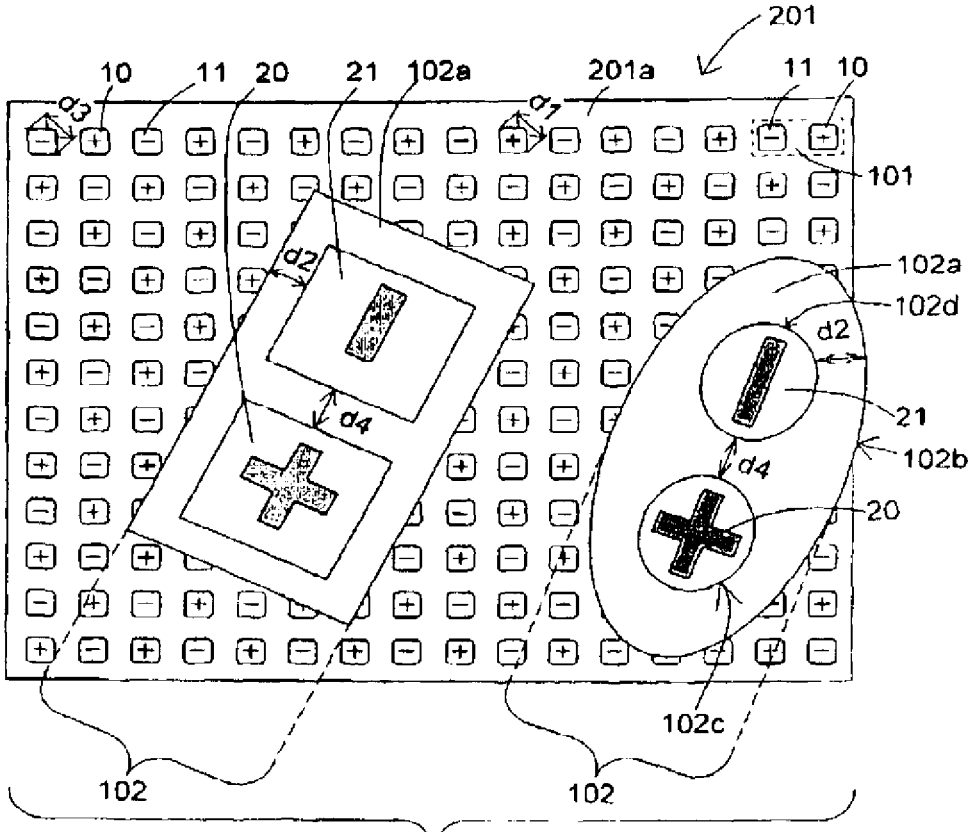

FIG. 15 is a top view schematic illustration of an exemplary, illustrative embodiment of an apparatus for transferring electrical power 100, according to the present invention.

The figure also depicts several dimensions crucial to the safety of the apparatus for transferring electrical power, according to the present invention.

The apparatus for transferring electrical power 100, according to the embodiment described at the present illustration, includes a planar stationary unit grid 201, which is comprised of a plurality of planar stationary unit sets 101, and a mobile unit set 102, also depicts several dimensions crucial to the safety of the apparatus for transferring electrical power, according to the present invention.

The embodiment of the mobile unit set 102 in the present illustration is different from other embodiments of the mobile unit set 102 described earlier only in its size and dimensions. The operational principles remain the same.

Planar stationary unit phase assemblies 10 and mobile unit phase assembly 20 serve in this instance for conducting a positive current, while planar stationary unit zero assemblies 11 and mobile unit zero assembly 21 serve in this instance for conducting a negative current and are set in a non-conductive planar stationary unit plus and minus assembly sets grid body 202*a*.

The dimension d3 is the largest cross section width dimension of the planar stationary unit phase assembly 10, and the dimension d1 is the largest cross section width dimension of the planar stationary unit zero assembly 11

The dimension d2 is the minimal distance of the mobile unit phase assembly 20, and from the mobile unit zero assembly 21 to the mobile unit set body edge 102*b*.

The dimension d4 is the distance between the mobile unit phase assembly 20 and the mobile unit zero assembly 21.

Dimensions d1, d2, d3, and d4 are measured from the top view, as depicted in the present illustration on the sides of the planar stationary unit set 101 and the mobile unit set 102 facing each other in the power transferring condition.

In order to prevent accidental contact between a live plate in the planar stationary unit grid 201 and a person, there must be sufficient insulation around the mobile unit phase assembly 20 and around the mobile unit zero assembly 21.

This is achieved by making the non-conductive mobile unit set body 102*a* large enough to overlap any live plates in the planar stationary unit grid 201. Therefore, the dimension d2 must be larger than each one of the dimensions d1 and d3.

In order to prevent any shorts between the mobile unit phase assembly 20 and the mobile unit zero assembly 21, the distance d4 between them must be large enough so that no live power plate in the planar stationary unit grid 201 may touch both plates in the mobile unit set 102 simultaneously.

This is achieved by making the distance d4 between the mobile unit phase assembly 20 and the mobile unit zero assembly 21 larger than d1.

This description refers to the case where all the dimensions of the planar stationary unit phase assemblies 10, and the planar stationary unit zero assemblies 11 of the planar stationary unit grid 201, are identical to each other.

The mobile unit set 102 depicts a case where the mobile unit phase assembly 20, is greatly larger than any single planar stationary unit phase assembly 10 and planar stationary unit zero assembly 11.

In such a case, it is not possible to use the planar stationary unit ground element 12 and the mobile unit ground element 22, as they would cause shorts between one of the contact elements in the mobile unit set 102 contact elements in the planar stationary unit grid 201.

Such a mobile unit set 102 (compared to a single planar stationary unit set 101) ensures that there will always be at least one planar stationary unit phase assembly 10 under the mobile unit phase assembly 20, and at least one planar stationary unit zero assembly 11 under the mobile unit zero assembly 21, with no regards to the orientation of the mobile unit set 102, on the plane seen in the top view of the present illustration, when placed on the planar stationary unit grid 201.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for transferring electrical power (100) comprising:

(a) at least one planar stationary unit set (101) including:

(i) a planar stationary unit phase assembly (10), having a predetermined maximum cross section width dimension d1; and (ii) a planar stationary unit zero assembly (11), having a predetermined maximum cross section dimension d3, wherein said planar stationary unit phase assembly (10) and said planar stationary unit zero assembly (11) being encased inside said planar stationary unit set (101) aside one another; and (b) at least one mobile unit set (102) including:

(i) a mobile unit phase assembly (20);

(ii) a mobile unit zero assembly (21); and (iii) a mobile unit set body (102*a*), wherein said mobile unit phase assembly (20) and said mobile unit zero assembly (21) being encased inside said mobile unit set body (102*a*), aside one another, and wherein said at least one mobile unit set (102) has a mobile unit set body edge (102*b*), wherein there is at least one of said planar stationary unit phase assembly (10) under said mobile unit phase assembly (20), and at least one of said planar stationary unit zero assembly (11) under said mobile unit zero assembly (21).

2. The apparatus for transferring electrical power (100) of claim 1, wherein each one of said mobile unit phase assembly (20) including:

a mobile unit zero assembly housing (20*h*);

a mobile unit assembly phase assembly contact element (20*a*) disposed on said mobile unit zero assembly housing (20*h*); and a mobile unit phase assembly magnet (20*e*) mounted inside said mobile unit zero assembly housing (20*h*), wherein said mobile unit phase assembly magnet (20*e*) has a mobile unit phase assembly magnet first magnetic pole (20*x*) and a mobile unit phase assembly magnet second magnetic pole (20*y*), wherein said mobile unit phase assembly magnet second magnetic pole (20*y*) is closer to said mobile unit assembly phase assembly contact element (20*a*) than said mobile unit phase assembly magnet first magnetic pole (20*x*), wherein each one of said mobile unit zero assembly (21) including:

a mobile unit zero assembly contact element (21*a*) disposed on said mobile unit zero assembly housing (21*h*); and a mobile unit zero assembly magnet (21*e*), wherein said mobile unit zero assembly magnet (21*e*), has a mobile unit zero assembly magnet first magnetic pole (21*x*), and a mobile unit zero assembly magnet second magnetic pole (21*y*), wherein said mobile unit phase assembly magnet first magnetic pole (20*x*) is closer to said mobile unit zero assembly contact element (21*a*) then said mobile unit zero assembly magnet second magnetic pole (21*y*), wherein said mobile unit phase assembly (20), has a mobile unit phase assembly edge (102*c*), and wherein said mobile unit zero assembly (21), has a mobile unit zero assembly edge (102*d*).

3. The apparatus for transferring electrical power (100) of claim 2, wherein said planar stationary unit phase assembly (10) is a magnetic switch phase assembly (40), wherein said magnetic switch phase assembly (40) including:

a magnetic switch phase assembly housing (40*h*);

a magnetic switch phase assembly housing end disk (40*i*) disposed on said magnetic switch phase assembly housing (40*h*);

a magnetic switch phase assembly contact element (40*a*) disposed on said magnetic switch phase assembly housing (40*h*);

a magnetic switch phase assembly shaft (40*c*) mounted inside said magnetic switch phase assembly housing (40*h*);

a magnetic switch phase assembly voltage element (40*b*) mounted on said magnetic switch phase assembly shaft (40*c*), wherein there is a first gap (40*z*) between said magnetic switch phase assembly contact clement (40*a*) and said magnetic switch phase assembly voltage element (40*b*);

a magnetic switch phase assembly magnet (40*e*) mounted on said magnetic switch phase assembly shaft (40*c*);

a magnetic switch phase assembly voltage element spring (40*g*) mounted inside said magnetic switch phase assembly housing (40*h*), and between said magnetic switch phase assembly voltage element (40*b*) and said magnetic switch phase assembly housing end disk (40*i*); and a magnetic switch phase assembly magnet spring (40*f*) mounted inside said magnetic switch phase assembly housing (40*h*), and between said magnetic switch phase assembly magnet (40*e*) and said magnetic switch phase assembly housing end disk (40*i*).

4. The apparatus for transferring electrical power (100) of claim 3, wherein said at least one planar stationary unit set (101) further including:

(v) a planar stationary unit ground element (12) encased inside said planar stationary unit set body (101*a*), and wherein said at least one mobile unit set (102) further including:

(v) a mobile unit ground element (22) encased inside said planar stationary unit set body (101*a*).

5. The apparatus for transferring electrical power (100) of claim 2, wherein said planar stationary unit phase assembly (10) is an electromagnetic switch assembly (32), wherein said electromagnetic switch assembly (32) including:

an electromagnetic switch assembly housing (32*h*);

an electromagnetic switch assembly housing end disk (32*i*) disposed on said electromagnetic switch assembly housing (32*h*);

an electromagnetic switch assembly contact element (32*a*) disposed on said electromagnetic switch assembly housing (32*h*);

an electromagnetic switch assembly shaft (32*c*) mounted inside said electromagnetic switch assembly housing (32*h*);

an electromagnetic switch assembly voltage clement (32*b*) mounted on said electromagnetic switch assembly shaft (32*c*), wherein there is a second gap (32*z*) between said electromagnetic switch assembly contact element (32*a*) and said electromagnetic switch assembly voltage element (32*b*);

an electromagnetic switch assembly electromagnet core (32*p*) mounted on said electromagnetic switch assembly shaft (32*c*);

an electromagnetic switch assembly electromagnet coil (32*q*) mounted on said electromagnetic switch assembly shaft (32*c*);

an electromagnetic switch assembly voltage clement spring (32*g*) mounted inside said electromagnetic switch assembly housing (32*h*) and between said electromagnetic switch assembly voltage element (32*b*) and said electromagnetic switch assembly housing end disk (32*i*); and an electromagnetic switch assembly electromagnet spring (32*f*) mounted inside said electromagnetic switch assembly housing (32*h*), and between said electromagnetic switch assembly electromagnet core (32*p*) and said electromagnetic switch assembly housing end disk (32*i*).

6. The apparatus for transferring electrical power (100) of claim 5, wherein said at least one planar stationary unit set (101) further including:

(v) a planar stationary unit ground element (12) encased inside said planar stationary unit set body (101*a*), and wherein said at least one mobile unit set (102) further including:

(v) a mobile unit ground clement (22) encased inside said planar stationary unit set body (101*a*).

7. The apparatus for transferring electrical power (100) of claim 2, wherein said planar stationary unit phase assembly (10) is a cantilever version of a magnetic switch assembly (34), wherein said cantilever version of a magnetic switch assembly (34) including:

a cantilever version of a magnetic switch assembly housing (34*h*);

a cantilever version of a magnetic switch assembly contact element (34*a*) disposed on said cantilever version of a magnetic switch assembly housing (34*h*);

a cantilever version of a magnetic switch assembly voltage element wire and assembly voltage element spring (34*jg*) disposed on said cantilever version of a magnetic switch assembly housing (34*h*) inside said cantilever version of a magnetic switch assembly housing (34*h*); and a cantilever version of a magnetic switch assembly magnet (34*e*) disposed on said cantilever version of a magnetic switch assembly voltage element wire and assembly voltage element spring (34*jg*), wherein there is a third gap (34*z*) between said cantilever version of a magnetic switch assembly contact element (34*a*) and said cantilever version of a magnetic switch assembly magnet (34*e*).

8. The apparatus for transferring electrical power (100) of claim 7, wherein said at least one planar stationary unit set (101) further including:

(v) a planar stationary unit ground clement (12) encased inside said planar stationary unit set body (101*a*), and wherein said at least one mobile unit set (102) further including:

(v) a mobile unit ground element (22) encased inside said planar stationary unit set body (101*a*).

9. The apparatus for transferring electrical power (100) of claim 2, wherein said planar stationary unit phase assembly (10) is a cantilever version of an electro-magnetic switch assembly (35), wherein said cantilever version of an electro-magnetic switch assembly (35) including:

a cantilever version of electro-magnetic switch assembly housing (35*h*);

a cantilever version of electro-magnetic switch assembly contact element (35*a*) disposed on said cantilever version of electro-magnetic switch assembly housing (35*h*);

a cantilever version of electro-magnetic switch assembly voltage element wire and assembly voltage element spring (35*jg*) disposed on said cantilever version of electro-magnetic switch assembly housing (35*h*) inside said cantilever version of electro-magnetic switch assembly housing (35*h*);

a cantilever version of electro-magnetic switch assembly core (35*p*) disposed on said cantilever version of electro-magnetic switch assembly voltage element wire and assembly voltage element spring (35*jg*); and a cantilever version of electro-magnetic switch assembly electromagnet coil (35*q*) mounted around said cantilever version of electro-magnetic switch assembly core (35*p*), wherein there is a fourth gap (35*z*) between said cantilever version of electro-magnetic switch assembly contact element (35*a*) and said cantilever version of electro-magnetic switch assembly core (35*p*).

10. The apparatus for transferring electrical power (100) of claim 9, wherein said at least one planar stationary unit set (101) further including:

(v) a planar stationary unit ground element (12) encased inside said planar stationary unit set body (101*a*), and wherein said at least one mobile unit set (102) further including:

(v) a mobile unit ground element (22) encased inside said planar stationary unit set body (101*a*).

11. The apparatus for transferring electrical power (100) of claim 2, wherein there is a minimum predetermined distance d4 between said mobile unit zero assembly edge (102*d*) and said mobile unit phase assembly edge (102*c*), wherein there is a minimum predetermined distance d2 from said mobile unit zero assembly edge (102*d*) to said mobile unit set body edge (102*b*), wherein said distance d4 is larger than said maximum cross section dimension d1 and is larger than said maximum cross section dimension d3, and wherein said distance d2 is larger than said maximum cross section dimension d1 and is larger than said maximum cross section dimension d3.

12. The apparatus for transferring electrical power (100) of claim 11, wherein said planar stationary unit phase assembly (10) is a magnetic switch phase assembly (40), wherein said magnetic switch phase assembly (40) including:

a magnetic switch phase assembly housing (40*h*);

a magnetic switch phase assembly housing end disk (401*i*) disposed on said magnetic switch phase assembly housing (40*h*);

a magnetic switch phase assembly contact element (40*a*) disposed on said magnetic switch phase assembly housing (40*h*);

a magnetic switch phase assembly shaft (40*c*) mounted inside said magnetic switch phase assembly housing (40*h*);

a magnetic switch phase assembly voltage element (40*b*) mounted on said magnetic switch phase assembly shaft (40*c*), wherein there is a first gap (40*z*) between said magnetic switch phase assembly contact element (40*a*) and said magnetic switch phase assembly voltage element (40*b*);

a magnetic switch phase assembly magnet (40*e*) mounted on said magnetic switch phase assembly shaft (40*c*);

a magnetic switch phase assembly voltage element spring (40*g*) mounted inside said magnetic switch phase assembly housing (40*h*), and between said magnetic switch phase assembly voltage element (40*b*) and said magnetic switch phase assembly housing end disk (40*i*); and a magnetic switch phase assembly magnet spring (40*f*) mounted inside said magnetic switch phase assembly housing (40*h*), and between said magnetic switch phase assembly magnet (40*e*) and said magnetic switch phase assembly housing end disk (40*i*).

13. The apparatus for transferring electrical power (100) of claim 12, wherein said apparatus for transferring electrical power (100) comprising:

(c) a planar stationary unit grid body (201*a*), wherein said planar stationary unit grid body (201*a*), connects together a plurality of said at least one planar stationary unit set (101).

14. The apparatus for transferring electrical power (100) of claim 11, wherein said planar stationary unit phase assembly (10) is an electromagnetic switch assembly (32), wherein said electromagnetic switch assembly (32) including:

an electromagnetic switch assembly housing (32*h*);

an electromagnetic switch assembly housing end disk (32*i*) disposed on said electromagnetic switch assembly housing (32*h*);

an electromagnetic switch assembly contact element (32*a*) disposed on said electromagnetic switch assembly housing (32*h*);

an electromagnetic switch assembly shaft (32*c*) mounted inside said electromagnetic switch assembly housing (32*h*);

an electromagnetic switch assembly voltage element (32*b*) mounted on said electromagnetic switch assembly shaft (32*c*), wherein there is a second gap (32*z*) between said electromagnetic switch assembly contact element (32*a*) and said electromagnetic switch assembly voltage element (32*b*);

an electromagnetic switch assembly electromagnet core (32*p*) mounted on said electromagnetic switch assembly shaft (32*c*);

an electromagnetic switch assembly electromagnet coil (32*q*) mounted on said electromagnetic switch assembly shaft (32*c*);

an electromagnetic switch assembly voltage element spring (32*g*) mounted inside said electromagnetic switch assembly housing (32*h*) and between said electromagnetic switch assembly voltage element (32*b*) and said electromagnetic switch assembly housing end disk (32*i*); and an electromagnetic switch assembly electromagnet spring (32*f*) mounted inside said electromagnetic switch assembly housing (32*h*), and between said electromagnetic switch assembly electromagnet core (32*p*) and said electromagnetic switch assembly housing end disk (32*i*).

15. The apparatus for transferring electrical power (100) of claim 14, wherein said apparatus for transferring electrical power (100) comprising:

(c) a planar stationary unit grid body (201*a*), wherein said planar stationary unit grid body (201*a*), connects together a plurality of said at least one planar stationary unit set (101).

16. The apparatus for transferring electrical power (100) of claim 11, wherein said planar stationary unit phase assembly (10) is a cantilever version of a magnetic switch assembly (34), wherein said cantilever version of a magnetic switch assembly (34) including:

a cantilever version of a magnetic switch assembly housing (34*h*);

a cantilever version of as magnetic switch assembly contact element (34*a*) disposed on said cantilever version of a magnetic switch assembly housing (34*h*);

a cantilever version of a magnetic switch assembly voltage element wire and assembly voltage element spring (34*jg*) disposed on said cantilever version of a magnetic switch assembly housing (34*h*) inside said cantilever version of a magnetic switch assembly housing (34*h*); and a cantilever version of a magnetic switch assembly magnet (34*e*) disposed on said cantilever version of a magnetic switch assembly voltage element wire and assembly voltage element spring (34*jg*), wherein there is a third gap (34*z*) between said cantilever version of a magnetic switch assembly contact element (34*a*) and said cantilever version of a magnetic switch assembly magnet (34*e*).

17. The apparatus for transferring electrical power (100) of claim 16, wherein said apparatus for transferring electrical power (100) comprising:

(c) a planar stationary unit grid body (201*a*), wherein said planar stationary unit grid body (201*a*), connects together a plurality of said at least one planar stationary unit set (101).

18. The apparatus for transferring electrical power (100) of claim 11, wherein said planar stationary unit phase assembly (10) is a cantilever version or an electro-magnetic switch assembly (35), wherein said cantilever version of an electro-magnetic switch assembly (35) including:

a cantilever version of electro-magnetic switch assembly housing (351*h*);

a cantilever version of electro-magnetic switch assembly contact element (35*a*) disposed on said cantilever version of electro-magnetic switch assembly housing (35*h*);

a cantilever version of electro-magnetic switch assembly voltage element wire and assembly voltage element spring (35*jg*) disposed on said cantilever version of electro-magnetic switch assembly housing (35*h*) inside said cantilever version of electro-magnetic switch assembly housing (35*h*);

a cantilever version of electro-magnetic switch assembly core (35*p*) disposed on said cantilever version of electro-magnetic switch assembly voltage element wire and assembly voltage element spring (35*jg*); and a cantilever version of electro-magnetic switch assembly electromagnet coil (35*q*) mounted around said cantilever version of electro-magnetic switch assembly core (35*p*), wherein there is a fourth gap (35*z*) between said cantilever version of electro-magnetic switch assembly contact element (35*a*) and said cantilever version of electro-magnetic switch assembly core (35*p*).

19. The apparatus for transferring electrical power (100) of claim 18, wherein said apparatus for transferring electrical power (100) comprising;

(c) a planar stationary unit grid body (201*a*), wherein said planar stationary unit grid body (201*a*), connects together a plurality of said at least one planar stationary unit set (101).

20. An apparatus for transferring electrical power (100) comprising:

(a) a plurality of planar stationary unit sets (101), wherein each one of said plurality of planar stationary unit sets (101) includes:

(i) a planar stationary unit phase assembly (10), having a predetermined maximum cross section dimension d1; and (ii) a planar stationary unit zero assembly (11), having a predetermined maximum cross section dimension d3, wherein said planar stationary unit phase assembly (10) and said planar stationary unit zero assembly (11) being encased inside said planar stationary unit set (101) aside one another; and (b) at least one mobile unit set (102), having a mobile unit set body edge (102*b*), wherein each one of said at least one mobile unit set (102) includes:

(i) a mobile unit phase assembly (20), having a mobile unit phase assembly edge (102*c*);

(ii) a mobile unit zero assembly (21), having a mobile unit zero assembly edge (102*d*); and (iii) a mobile unit set body (102*a*), wherein said mobile unit phase assembly (20) and said mobile unit zero assembly (21) being encased inside said mobile unit set body (102*a*), aside one another, and wherein said at least one mobile unit set (102) has a mobile unit set body edge (102*b*), wherein there is a minimal distance d2 from said mobile unit zero assembly edge (102*d*) to said mobile unit set body edge (102*b*), wherein there is a distance d4 between said mobile unit zero assembly edge (102*d*) and said mobile unit phase assembly edge (102*c*), wherein each one of said minimal distance d2 from said mobile unit zero assembly edge (102*d*) to said mobile unit set body edge (102*b*) is larger than each one of said maximum cross section dimension d1 of said planar stationary unit phase assembly (10), wherein each one of said minimal distance d2 from said mobile unit zero assembly edge (102*d*) to said mobile unit set body edge (102*b*) is larger than said maximum cross section dimension d3 of each one of said planar stationary unit zero assembly (11), wherein each one of said distance d4 is larger than said maximum cross section dimension d1 of each one of said planar stationary unit phase assembly (10), wherein there is at least one of said planar stationary unit phase assembly (10) under said mobile unit phase assembly (20), and at least one of said planar stationary unit zero assembly (11) under said mobile unit zero assembly (21).

* * * * *

UNITED STATES PATENT AND TRADEMARK OFFICE

CERTIFICATE OF CORRECTION

PATENT NO. : 7,931,472 B2
APPLICATION NO. : 12/843028
DATED : April 26, 2011
INVENTOR(S) : Arnon Haim David et al.

It is certified that error appears in the above-identified patent and that said Letters Patent is hereby corrected as shown below:

Title Page (54), and Col. 1, line 1, please delete "APPARATUS FOR TRANSFERRING ELECTRIC POWER FROM A MOBILE UNIT PLACED IN VARIOUS ORIENTATION ON A STATIONARY UNIT" and insert --APPARATUS FOR TRANSFERRING ELECTRICAL POWER FROM A SOURCE PLANE TO A RECEIVING DEVICE PLACED IN VARIOUS ORIENTATIONS ON SUCH PLANE--.

In column 20, lines 56-57 (claim 1), please delete "cross section width dimension d1;" and insert --cross section dimension d1;--.

Signed and Sealed this
Ninth Day of April, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,931,472 B2
APPLICATION NO. : 12/843028
DATED : April 26, 2011
INVENTOR(S) : David et al.

It is certified that error appears in the above-identified patent and that said Letters Patent is hereby corrected as shown below:

In the Drawings:

In Fig. 14a, Sheet 17 of 17, for Tag "72", in Line 2, delete "CONVECTOR" and insert -- CONVERTER --, therefor.

Delete Sheet 17 and substitute the attached sheet 17 therefor.

In the Specifications:

In Column 2, Line 6, delete "open." and insert -- open, --, therefor.

In Column 2, Line 54, delete "grater" and insert -- greater --, therefor.

In Column 12, Line 4, delete "body" and insert -- body. --, therefor.

In Column 16, Line 44, delete "in to the a planar" and insert -- into a planar --, therefor.

In Column 17, Line 34, delete "in to" and insert -- into --, therefor.

In Column 17, Line 55, delete "102a" and insert -- 102a. --, therefor.

In Column 18, Line 62, delete "thorough" and insert -- through --, therefor.

In Column 19, Line 64, delete "11" and insert -- 11. --, therefor.

In the Claims:

In Column 21, Line 60, in Claim 3, delete "clement" and insert -- element --, therefor.

Signed and Sealed this
Twenty-first Day of May, 2013

Teresa Stanek Rea

Teresa Stanek Rea
*Acting Director of the United States Patent and Trademark Office*

In Column 22, Line 33, in Claim 5, delete “clement” and insert -- element --, therefor.

In Column 22, Line 45, in Claim 5, delete “clement” and insert -- element --, therefor.

In Column 22, Line 64, in Claim 6, delete “clement” and insert -- element --, therefor.

In Column 23, Line 25, in Claim 8, delete “clement” and insert -- element --, therefor.

In Column 24, Line 17, in Claim 12, delete “(401i)” and insert -- (40i) --, therefor.

In Column 25, Line 38, in Claim 16, delete “as” and insert -- a --, therefor.

In Column 25, Line 63, in Claim 18, delete “or” and insert -- of --, therefor.

In Column 25, Line 67, in Claim 18, delete “(351h);” and insert -- (35h); --, therefor.

In Column 26, Line 24, in Claim 19, delete “comprising;” and insert -- comprising: --, therefor.